US011505889B2

(12) United States Patent
Chae et al.

(10) Patent No.: US 11,505,889 B2
(45) Date of Patent: Nov. 22, 2022

(54) WASHING MACHINE AND CONTROL METHOD OF SAME

(71) Applicant: LG Electronics Inc., Seoul (KR)

(72) Inventors: Kyosoon Chae, Seoul (KR); Hyundong Kim, Seoul (KR); Sooyoung Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 182 days.

(21) Appl. No.: 16/845,975

(22) Filed: Apr. 10, 2020

(65) Prior Publication Data

US 2020/0325620 A1 Oct. 15, 2020

(30) Foreign Application Priority Data

Apr. 12, 2019 (KR) ..... 10-2019-0042787

(51) Int. Cl.

| | |
|---|---|
| ***D06F 39/02*** | (2006.01) |
| ***D06F 33/37*** | (2020.01) |
| ***D06F 34/18*** | (2020.01) |
| ***D06F 103/22*** | (2020.01) |
| ***D06F 105/42*** | (2020.01) |
| *D06F 33/57* | (2020.01) |

(52) U.S. Cl.

CPC ..... *D06F 39/022* (2013.01); *D06F 33/37* (2020.02); *D06F 34/18* (2020.02); *D06F 39/02* (2013.01); *D06F 33/57* (2020.02); *D06F 2103/22* (2020.02); *D06F 2105/42* (2020.02)

(58) Field of Classification Search

CPC ..... D06F 33/37; D06F 33/57; D06F 34/18; D06F 39/02; D06F 39/022; D06F 2103/22; D06F 2105/42

See application file for complete search history.

(56) References Cited

U.S. PATENT DOCUMENTS

2009/0288453 A1* 11/2009 Lee ..... D06F 39/022 68/17 R

2010/0161143 A1 6/2010 Smith et al.

(Continued)

FOREIGN PATENT DOCUMENTS

DE 102008047941 3/2010
DE 102016212985 1/2018

(Continued)

OTHER PUBLICATIONS

Machine translation of KR-20150103988-A to LG Electronics. (Year: 2015).*

(Continued)

*Primary Examiner* — Joseph L. Perrin

(74) *Attorney, Agent, or Firm* — Fish & Richardson P.C.

(57) ABSTRACT

The present disclosure relates to a washing machine and a control method of the same. The washing machine includes: a detergent supply device which supplies a liquid additive to the tub; and a controller which controls the operation of the detergent supply device. The detergent supply device includes: a plurality of cartridges which contain the additive respectively; an electrode sensor which detects conductivity of the additive contained in the plurality of cartridges; and a pump which extracts the additive contained in the cartridge. The controller determines a type of additive contained in the cartridge based on a detection value of the electrode sensor.

15 Claims, 21 Drawing Sheets

(56) References Cited

U.S. PATENT DOCUMENTS

| | | | | |
|---|---|---|---|---|
| 2016/0289883 | A1* | 10/2016 | Lv | D06F 39/02 |
| 2018/0156725 | A1 | 6/2018 | Kessler et al. | |
| 2019/0301073 | A1* | 10/2019 | Kessler | D06F 33/36 |

FOREIGN PATENT DOCUMENTS

| | | | | | |
|---|---|---|---|---|---|
| EP | 2521811 | B1 | | 3/2015 | |
| EP | 3075897 | | | 10/2016 | |
| JP | 2011244885 | | | 12/2011 | |
| JP | 2018011618 | | | 1/2018 | |
| JP | 2018175395 | | | 11/2018 | |
| KR | 1019990074113 | | | 10/1999 | |
| KR | 1020090115051 | | | 11/2009 | |
| KR | 1020110099288 | | | 9/2011 | |
| KR | 1020130062271 | | | 6/2013 | |
| KR | 20150103988 | A | * | 9/2015 | D06F 39/02 |
| WO | WO2015197108 | | | 12/2015 | |
| WO | WO2017005525 | | | 1/2017 | |

OTHER PUBLICATIONS

Extended European Search Report in European Application No. 20169269.6, dated Aug. 20, 2020, 9 pages.
PCT International Search Report in International Application No. PCT/KR2020/004928, dated Aug. 12, 2020, 3 pages.

* cited by examiner

FIG. 23A

| ADDITIVE CLASSIFICATION | LOAD1 | LOAD2 | LOAD3 | LOAD4 | LOAD5 |
|---|---|---|---|---|---|
| GENERAL DETERGENT | 53 | 69 | 72 | 95 | 113 |
| WOOL DETERGENT | 43 | 65 | 80 | 110 | 183 |
| BABY DETERGENT | 29 | 49 | 59 | 82 | 122 |
| OUTDOOR DETERGENT | 31 | 52 | 60 | 89 | 149 |
| BLEACH | 19 | 29 | 32 | 48 | 60 |
| FABRIC SOFTENER | 18 | 28 | 33 | 46 | 68 |

FIG. 23B

| ADDITIVE CLASSIFICATION | LOAD1 | LOAD2 | LOAD3 | LOAD4 | LOAD5 |
|---|---|---|---|---|---|
| GENERAL DETERGENT | 21 | 28 | 29 | 38 | 45 |
| WOOL DETERGENT | 17 | 26 | 32 | 44 | 73 |
| BABY DETERGENT | 12 | 19 | 24 | 33 | 49 |
| OUTDOOR DETERGENT | 13 | 21 | 24 | 36 | 60 |
| BLEACH | 8 | 12 | 13 | 19 | 24 |
| FABRIC SOFTENER | 7 | 11 | 13 | 19 | 27 |

WASHING MACHINE AND CONTROL METHOD OF SAME

CROSS-REFERENCE TO RELATED APPLICATION

This application claims the benefit of priority to Korean Application No. 10-2019-0042787, filed on Apr. 12, 2019, the disclosure of which is incorporated by reference in its entirety.

BACKGROUND

1. Technical Field

The present disclosure relates to a washing machine and a control method of the same, and more particularly, to a washing machine capable of automatically supplying various types of detergents, and a control method of washing machine.

2. Description of the Related Art

A washing machine is an apparatus for processing laundry through various actions such as washing, dehydration and/or drying. A washing machine is an apparatus that removes contamination from laundry (hereinafter, also referred to as "cloth") by using water and detergent.

Recently, various types of detergents have been launched, as well as general laundry detergents and fabric softeners.

Accordingly, there is an increasing demand for an automatic detergent supply device that automatically mixes and supplies various types of detergents to suit the cloth, and related technologies are actively being developed.

Patent Publication No. 10-1999-0074113 (hereinafter also referred to as "prior art document 1") relates to a washing machine that detects the amount of detergent in a detergent container and warns for replenishment at a certain level or lower, and discloses a detergent sensor installed in a detergent container or a metering container to detect the amount of detergent.

Prior Document 1 discloses only a detergent sensor that detects the amount of detergent in the detergent container, and does not disclose a method for detecting the type of detergent that is contained in the detergent container. Therefore, there is a problem in that a user has to input a preset detergent into each detergent container.

In addition, when the user puts a detergent excluding a preset detergent in each detergent container, there is a problem in that washing proceeds without inputting an appropriate detergent suitable for the laundry and the washing course.

Patent Publication No. 10-2011-0099288 (hereinafter, also referred to as "prior art document 2") discloses a modular fluid distribution system including at least one container accommodating fluid, and a fluid level detection system configured to detect a level of fluid in the container.

The prior art document 2 discloses only a detection system that detects the amount of the container in which the fluid is accommodated, and does not disclose a method of detecting the type of detergent that is contained in the container. Therefore, there is a problem as in the prior document 1.

SUMMARY

The present disclosure has been made in view of the above problems, and provides a washing machine capable of determining the type of an additive such as a detergent, a fabric softener contained in a cartridge.

The present disclosure further provides a washing machine capable of automatically inputting appropriate additives according to a washing course.

The present disclosure further provides a washing machine capable of inputting appropriate additives into a tub according to a washing course among various types of additives contained in a plurality of cartridges, even if a user does not input a preset additive for each of the plurality of cartridges.

In order to achieve the above object, the washing machine according to an embodiment of the present disclosure includes a detergent supply device which supplies a plurality of additives to the washing machine, and a controller which controls the operation of the detergent supply device.

The additive may be a liquid additive.

The detergent supply device includes a plurality of cartridges which contain the additive respectively, a sensor which detects a type of additive contained in the plurality of cartridges, and a pump which extracts the additive contained in the cartridge.

The sensor may be an electrode sensor that detects the conductivity of the additive.

The detergent supply device includes a cartridge housing in which the plurality of cartridges are detachably seated.

The electrode sensor includes an electrode plate installed in the cartridge and a terminal installed in the cartridge housing.

The electrode plate has one surface which is installed to be in contact with the additive contained in the cartridge.

The electrode plate is installed so that the other surface opposite to the one surface is exposed to the outside of the cartridge.

The terminal is installed in a position facing the other surface of the electrode plate.

The electrode plate and the terminal are in contact with each other when the cartridge is seated in the cartridge housing.

The electrode sensor includes: a plurality of electrode plates which are respectively installed in the plurality of cartridges; and a plurality of terminals which are installed in the cartridge housing, and installed respectively in a position facing the plurality of electrode plates.

A plurality of electrode sensors are provided, and the plurality of electrode sensors detect the conductivity of the additive contained in the plurality of cartridges respectively.

The washing machine includes a memory in which conductivity data according to the type of additive is stored, a communication unit that exchanges data with the certain server, and an input put which receives washing course.

Data related to voltage is stored in the memory, as the conductivity data according to the type of the additive.

The controller determines the type of additive contained in the cartridge from the detected value of the electrode sensor. The controller determines the type of additive contained in the cartridge by comparing the detection value of the electrode sensor with the data stored in the memory. The controller measures a voltage applied to an electrode of the electrode sensor by applying a current to the electrode sensor, and determines the type of additive contained in the cartridge by comparing the measured voltage with the data related to voltage stored in the memory.

The communication unit transmits the detection value of the electrode sensor to a certain server. The communication unit transmits the measured voltage to the certain server. The communication unit receives data related to the conductivity of the additive from the certain server. The communication unit receives data on voltage as conductivity data of the additive from the certain server.

The controller updates the memory based on the data related to the conductivity of the additive received from the certain server.

The controller selects an additive to be input to the tub according to the received washing course. The controller connects the pump with the cartridge containing the selected additive.

The detergent supply device includes: an inlet flow path which have a plurality of flow paths respectively connected to the plurality of cartridges; and a flow path switching valve which selectively communicates the pump with any one of the plurality of flow paths of the inlet flow path.

The controller controls the flow path switching valve to communicate the pump with a flow path connected to a cartridge containing the selected additive among the plurality of flow paths of the inlet flow path.

In order to achieve the above object, a method of controlling a washing machine according to an embodiment of the present disclosure includes the steps of: detecting conductivity of additive contained in the plurality of cartridges from an electrode sensor; determining a type of the additive contained in each of the plurality of cartridges by comparing the detected conductivity value with data on the type of additive previously stored in a memory; receiving a washing course through an input unit; selecting a preset additive according to the received washing course, by a controller, after receiving a washing course and determining a type of the additive; and extracting the selected additive by a pump.

The method further includes: receiving data according to an additive type from a certain server through a communication unit; and updating data stored in the memory based on the data received from the certain server, before determining a type of the additive.

Determining a type of the additive includes: when the conductivity value detected by the electrode sensor is the same as any one of data on the type of additive stored in the memory, determining the additive whose conductivity is detected as an additive of the any one of data; and when the conductivity value detected by the electrode sensor is different from all the data on the type of additive stored in the memory, determining the additive whose conductivity is detected as an additive of the closest data to the detected conductivity value.

The conductivity value detected by the electrode sensor is different from all the data on the type of additive stored in the memory, further comprising transmitting the detected conductivity value to the certain server through the communication unit.

After determining a type of the additive includes, further comprising displaying the type of the additive contained in each of the plurality of cartridges through a display unit.

BRIEF DESCRIPTION OF THE DRAWINGS

The above and other objects, features and advantages of the present disclosure will be more apparent from the following detailed description in conjunction with the accompanying drawings, in which:

FIGS. 23A and 23B exemplarily show the amount of additive to be introduced into a tub according to the type and amount of the additive.

DETAILED DESCRIPTION

Figure 1:
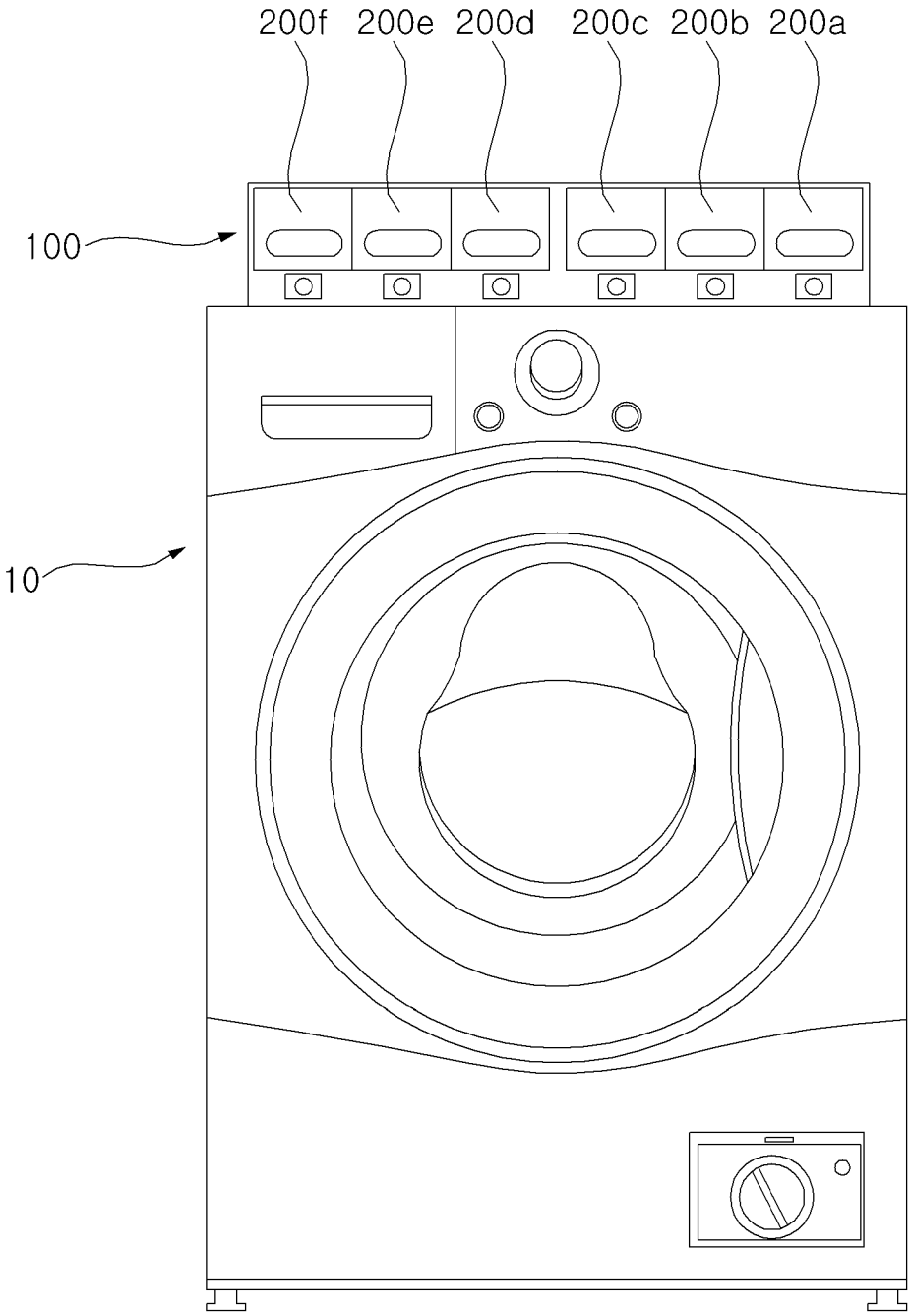
FIG. 1 is a front view of a washing machine according to an embodiment of the present disclosure.

Advantages and features of the present disclosure and methods for achieving them will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the invention to those skilled in the art. The present disclosure is defined only by the scope of the claims. Like reference numerals refer to like elements throughout the specification.

Hereinafter, the present disclosure will be described with reference to the drawings for explaining a washing machine and a control method of the washing machine according to embodiments of the present disclosure.

Figure 2:
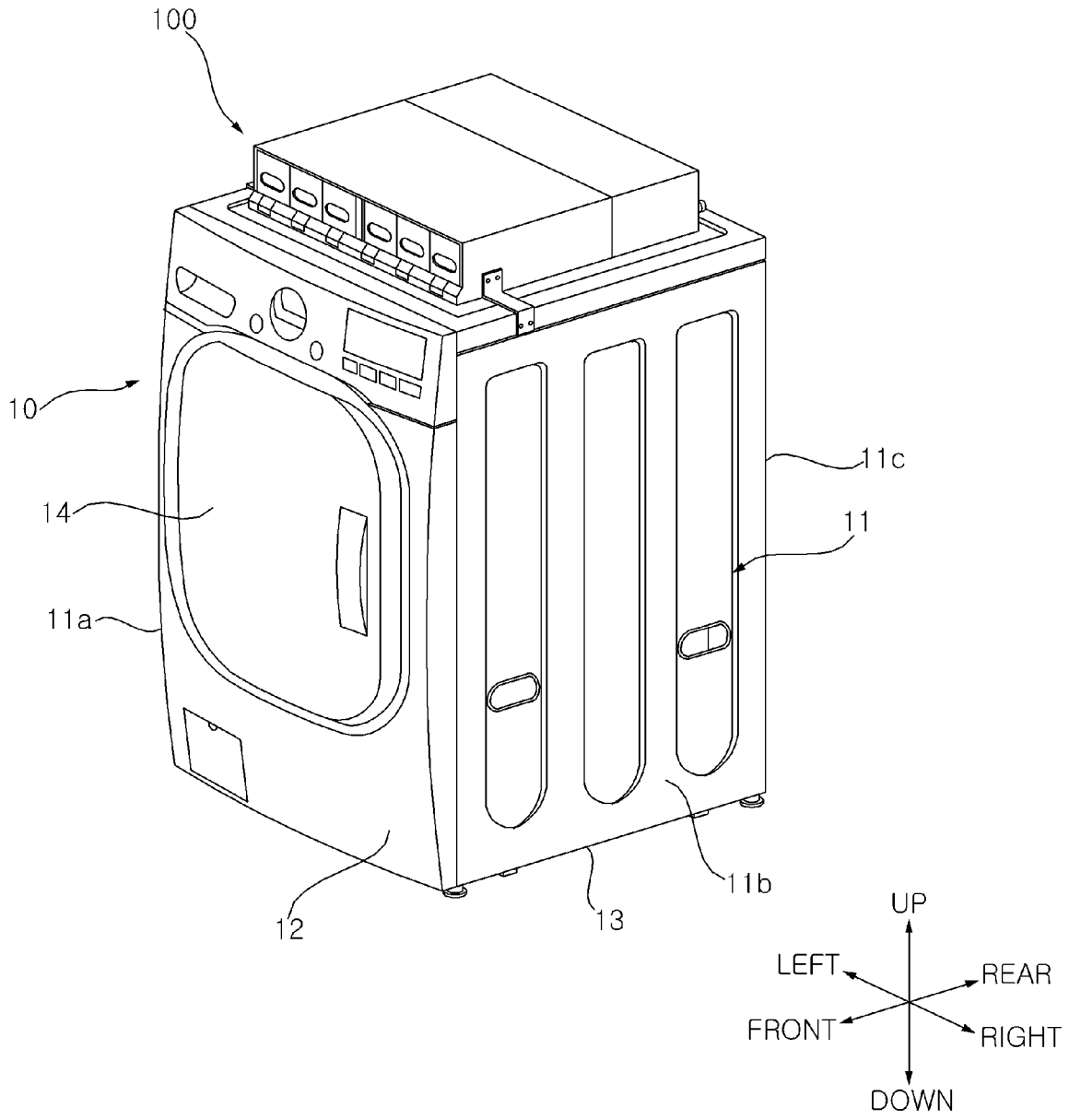
FIG. 2 is a perspective view of a washing machine according to an embodiment of the present disclosure.
Figure 3:
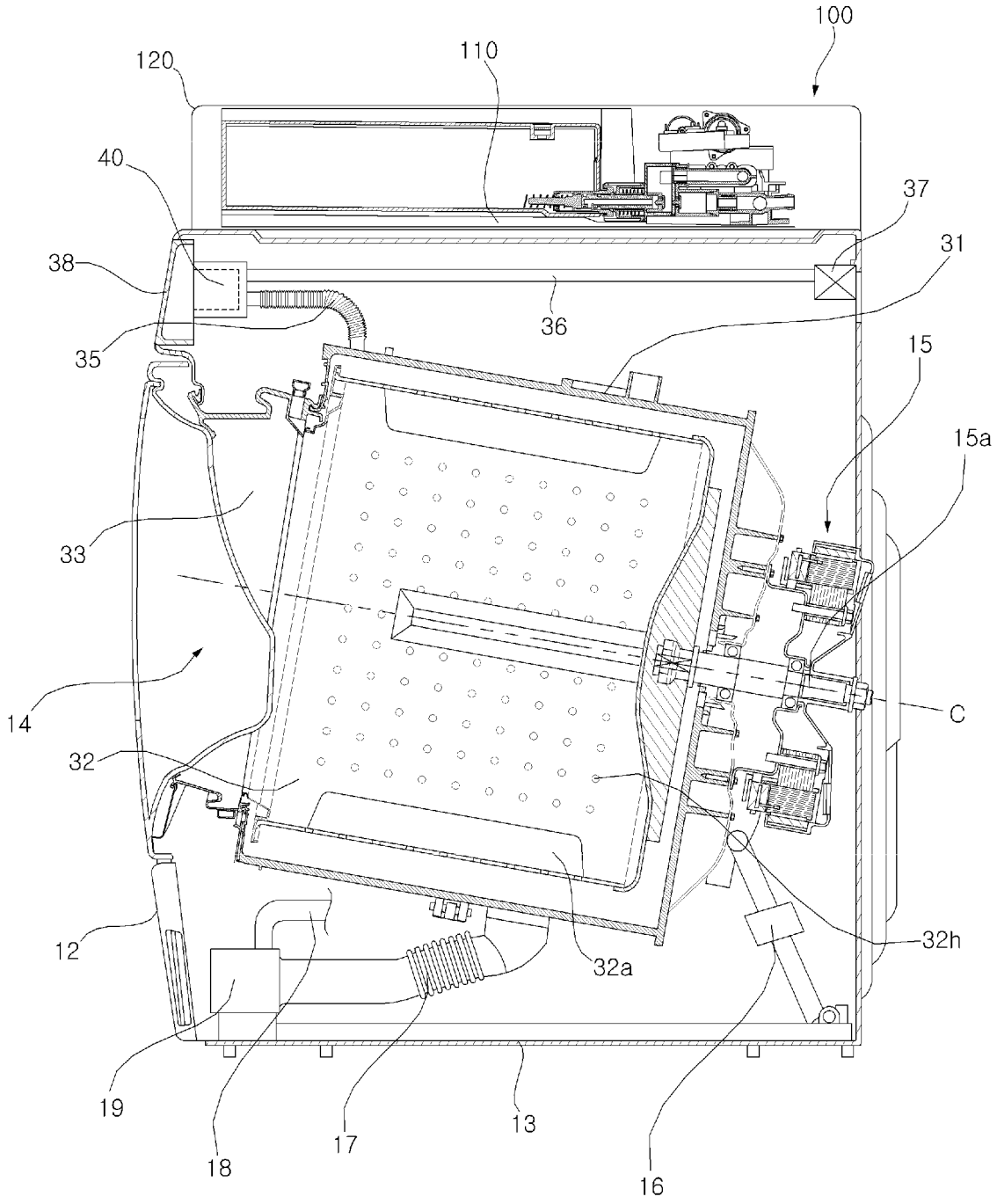
FIG. 3 is a side cross-sectional view of a washing machine according to an embodiment of the present disclosure.

Referring to FIGS. 1 to 3, a washing machine according to an embodiment of the present disclosure includes a tub 31 in which water is stored, a drum 32 which is rotatably provided in the tub 31 and receives laundry, and a detergent supply device for supplying a detergent, a fabric softener, a bleaching agent, and the like (hereinafter, also referred to as "additive") to the tub 31. In addition, the washing machine may include a cabinet 10 in which the tub 31 and the drum 32 are accommodated.

The detergent supply device 100 may be installed in the upper surface of the cabinet 10 separately from a main body of the washing machine, or may be integrally installed with the main body of the washing machine in the inside of the cabinet 10. Hereinafter, a case where the detergent supply device 100 is installed separately from the main body of the washing machine will be described as an example.

The cabinet 10 forms an outer shape of the washing machine, and the tub 31 and the drum 32 are accommodated therein. The cabinet 10 includes a main frame 11 having a front surface that is open and having a left side surface 11*a*, a right side surface 11*b*, and a rear side surface 11*c*, a front panel 12 which is coupled to the open front surface of the main frame 11 and in which a loading port is formed, and a horizontal base 13 supporting the main frame 11 and the front panel 12 from the lower side. The door 14 for opening and closing the loading port is rotatably coupled to the front panel 12.

The front panel 12 and the tub 31 are communicated by an annular gasket 33. The front end portion of the gasket 33 is fixed to the front panel 12, and the rear end portion is fixed around an inlet of the tub 31. The gasket 33 is formed of a material having elasticity, and prevents water in the tub 31 from leaking.

A driving unit 15 is located on the rear side of the drum 32 to rotate the drum 32. In addition, a water supply hose (not shown) for guiding water supplied from an external water source, and a water supply unit 37 for controlling water supplied through the water supply hose to be supplied to a water supply pipe 36 may be provided. The water supply unit 37 may include a water supply valve (not shown) that controls the water supply pipe 36.

The cabinet 10 is provided with a drawer 38 for receiving detergent and a drawer housing 40 in which the drawer 38 is retractably accommodated. The detergent may include bleach or fabric softener as well as laundry detergent. The detergent accommodated in the drawer 38 is supplied to the tub 31 through a water supply bellows 35 when water is supplied through the water supply pipe 36. A water supply port (not shown) connected to the water supply bellows 35 may be formed in the side surface of the tub 31.

A drain hole for discharging water is formed in the tub 31, and a drain bellows 17 is connected to the drain hole. A drain pump 19 is provided to pump and discharge the water discharged from the tub 31 through the drain bellows 17 to the outside of the washing machine.

Figure 4:
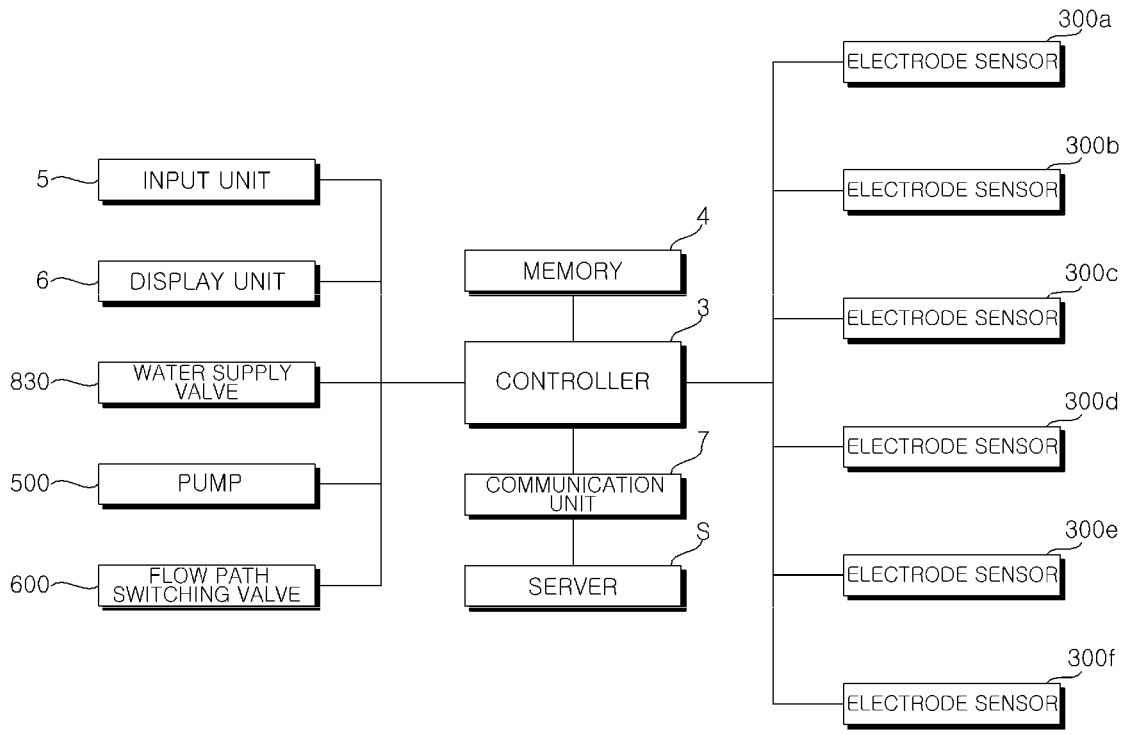
FIG. 4 is a block diagram showing a control of a washing machine according to an embodiment of the present disclosure.
Figure 5:
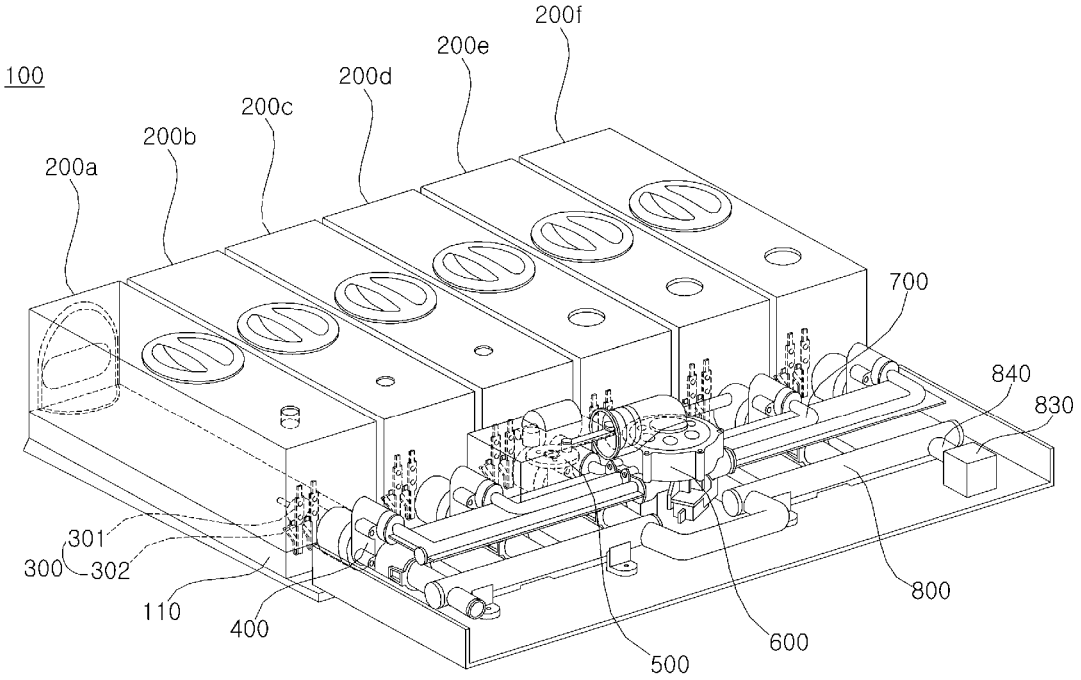
FIG. 5 is a perspective view of a detergent supply device of a washing machine according to an embodiment of the present disclosure.
Figure 6:
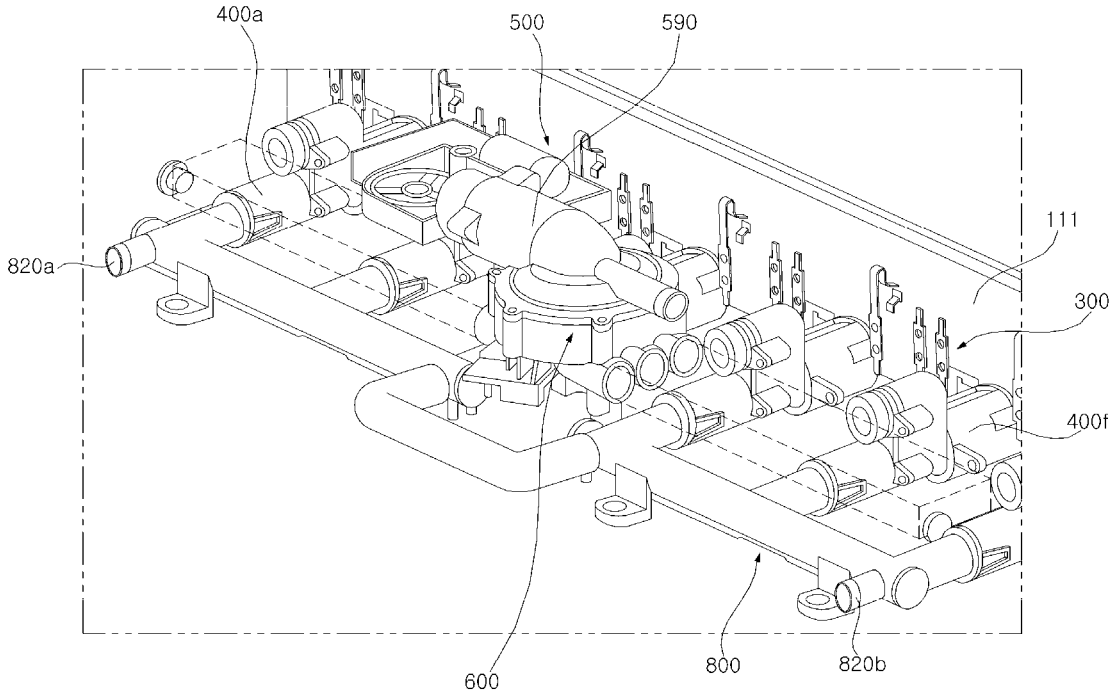
FIG. 6 is a perspective view of another angle of the detergent supply device shown in FIG. 5.
Figure 7:
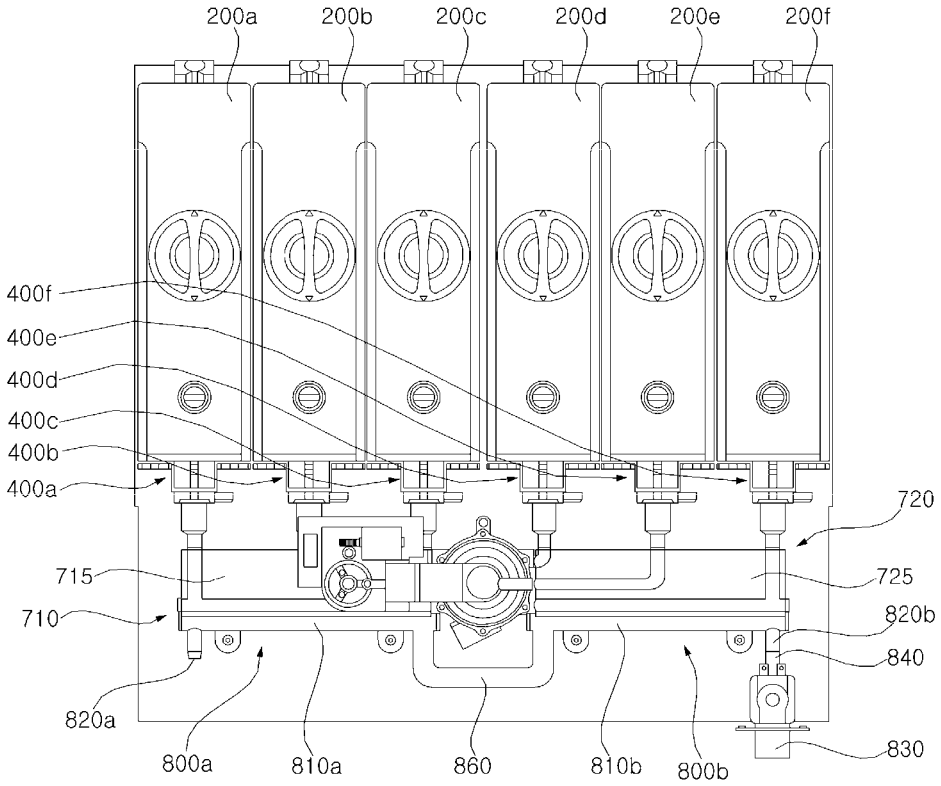
FIG. 7 is a plan view of a washing machine according to an embodiment of the present disclosure.

Referring to FIG. 4, the washing machine according to an embodiment of the present disclosure may include a controller 3 for controlling the operation of a driving unit 15, a detergent supply device 100, and the like, a memory 4 for storing additive and washing course information, and a communication unit 7 which exchanges data with a certain server S. In addition, it may include an input unit 5 for receiving various control commands for the operation of the washing machine from a user, and a display unit 6 for displaying the operating state of the washing machine.

The controller 3 may control a pump 500, a flow path switching valve 600, and the like, which will be described later. The controller 3 may be installed in a main body of the washing machine. Alternatively, the controller 3 may be installed in the main body of the washing machine and the detergent supply device 100 respectively, and exchange information with each other.

Information on additive, such as components constituting the additive and the composition ratio of the components may be stored in the memory 4. Each cartridge 200 accommodates any one of the above components, and the controller 3 may control the pump 500 and the flow path switching valve 600 based on the additive information stored in the memory 4.

In the memory 4, information of additives accommodated in each cartridge 200 collected from the electrode sensor 300 described later may be stored. The communication unit 7 may transmit information stored in the memory 4 to a certain server S, receive information from the certain server S, and update information stored in the memory 4.

The input unit 5 and the display unit 6 may be provided in the upper portion of the front panel 12. The input unit 5 and the display unit 6 may be provided separately, or may be integrally provided through a display device capable of inputting and outputting.

According to a setting such as a washing course input through the input unit 5 by a user, the controller 3 may select an additive type from the memory 4 and check corresponding additive information. The controller may control the operation of the pump 500 and the flow path switching valve 600 to put the selected additive into the tub.

Referring to FIGS. 5 to 8, the detergent supply device 100 includes a plurality of cartridges 200*a*, 200*b*, 200*c*, 200*d*, 200*e*, 200*f* (hereinafter, 200) containing the additives respectively, an electrode sensor 300 for detecting the information of the additive contained in the cartridge 200, a pump 500 for extracting the additive contained in the cartridge 200. In addition, the detergent supply device 100 includes a plurality of check valve assemblies 400*a*, 400*b*, 400*c*, 400*d*, 400*e*, 400*f* (hereinafter, 400) respectively connected to the plurality of cartridges 200 to control the extracting of the additive, an inlet flow path 700 having a plurality of flow paths 700*a*, 700*b*, 700*c*, 700*d*, 700*e*, 700*f* respectively connected to the plurality of check valve assemblies 400, and a flow path switching valve 600 which are connected to the pump 500 and the inlet flow path 700 and selectively communicate the pump 500 with any one flow path (e.g. 700*a*) of the plurality of flow paths 700*a*, 700*b*, 700*c*, 700*d*, 700*e*, 700*f* (hereinafter, 700*a*) of the inlet flow path 700.

In addition, the detergent supply device 100, may include an electrode sensor 300 for detecting the amount of the additive accommodated in the cartridge 200, a water supply valve 830 receiving water from an external water source, and an outlet flow path 800 through which the water supplied from the water supply valve 830 and the additive extracted from the cartridge 200 flow.

The inlet flow path 700 may transmit a pressure change generated by the pump 500 to the check valve assembly 400. In the check valve assembly 400, a space S2 in which the extracted additive is temporarily stored is formed, and the pump 500 changes the pressure in the space to extract the additive from the plurality of cartridges to the check valve assembly 400. The outlet flow path 800 is provided with a plurality of check valve connecting pipes 850*a*, 850*b*, 850*c*, 850*d*, 850*e*, 850*f* (hereinafter, 850) which are respectively connected to the plurality of check valve assemblies, so that the extracted additive can be discharged to the outlet flow path 800.

The detergent supply device 100 includes a cartridge housing 110 which has an inlet formed in the front surface and defines an accommodation space therein, and a cover 120 for opening and closing the cartridge housing 110.

A plurality of cartridges 200 may be detachably seated in the cartridge housing 110. A plurality of openings formed of a rectangular parallelepiped are formed in the front side of the cartridge housing 110, and each opening is extended to the rear side of the cartridge housing 110, and forms a cartridge accommodating space for each opening. Accordingly, a plurality of cartridges 200 may be inserted into the respective opening spaces through the front opening.

Each cartridge 200 contains additive, for example, may contain additive of different composition, such as general laundry detergent, wool detergent, baby clothes detergent, outdoor clothes detergent, bleach, and fabric softener. The additive may be a liquid additive.

The cartridge 200 according to the embodiment of the present disclosure is formed of six cartridges, but the number is not necessarily limited thereto, preferably, three or more cartridges can be provided.

In the rear space of the cartridge 200 accommodating space, an accommodating space in which detergent supply part such as the flow path 700 and 800, the flow path switching valve 600, and the pump 500 are installed is formed. Between the cartridge accommodating space and a rear side part accommodating space, a cartridge connection wall 111*a*, 111*b*, 111*c*, 111*d*, 111*e*, 111*f* (hereinafter, 111) is installed, and an electrode sensor 300 including a terminal 310 and an electrode plate 320 described later is installed in the cartridge connection wall 111.

Hereinafter, the cartridge 200 will be described with reference to FIGS. 5 to 11.

The cartridge 200 includes a cartridge body 210*a*, 210*b*, 210*c*, 210*d*, 210*e*, 210*f* (hereinafter, 210) forming a main body and storing the additive, a first opening 211*a*, 211*b*, 211*c*, 211*d*, 211*e*, 211*f* (hereinafter, 211) into which the additive can be added to the cartridge body 210, a cap 220*a*, 220*b*, 220*c*, 220*d*, 220*e*, 220*f* (hereinafter, 220) that can open and close the first opening, a membrane 230*a*, 230*b*, 230*c*, 230*d*, 230*e*, 230*f* (hereinafter, 230) which passes air inside and outside the cartridge 200, a second opening 213*a*, 213*b*, 213*c*, 213*d*, 213*e*, 213*f* (hereinafter, 213) in which the membrane 230 is installed, a cartridge locker 240*a*, 240*b*, 240*c*, 240*d*, 240*e*, 240*f* (hereinafter, 240) to allow the cartridge 200 to be fixed to the housing 110 when the cartridge 200 is inserted into the housing 110, a docking valve 250*a*, 250*b*, 250*c*, 250*d*, 250*e*, 250*f* (hereinafter, 250) connecting the check valve assembly 400 and the cartridge 200, and a rib 260*a*, 260*b*, 260*c*, 260*d*, 260*e*, 260*f* (hereinafter, 260) that prevent additive from contacting the membrane 230.

The cartridge body 210 is formed to correspond to the shape of the housing 110 so as to be inserted and coupled to the cartridge accommodating space formed in the front side of the housing 110. According to an embodiment of the present disclosure, a cartridge accommodating portion 110*a*, 110*b*, 110*c*, 110*d*, 110*e*, 110*f* (hereinafter 110) of the housing 110 is formed in the shape of a rectangular parallelepiped, the cartridge 200 is also formed in a corresponding rectangular parallelepiped, but the edge is formed to be rounded to minimize wear when the cartridge 200 is detached.

The cartridge body 210 has a docking valve insertion hole formed in one surface thereof, and the docking valve 250 may be inserted into the insertion hole and installed in the cartridge body 210. The docking valve insertion hole may be formed in the rear surface of the cartridge body 210. The insertion hole may be formed below the rear surface so that additive can flow out to the check valve assembly 400 through the docking valve 250 even when a small amount of additive is contained in the cartridge.

For the above reasons, the cartridge 200 may be installed to be inclined downward toward the rear. In more detail, the cartridge 200 may be disposed such that the bottom surface inside the cartridge body 210 is inclined downward toward the direction in which the insertion hole is formed. When the insertion hole is formed in the rear surface of the cartridge body 210, the cartridge 200 may be disposed such that the bottom surface inside the cartridge body 210 is inclined downward toward the rear side.

Hereinafter, the electrode sensor 300 will be described with reference to FIGS. 8 and 10 to 14.

Figure 10:
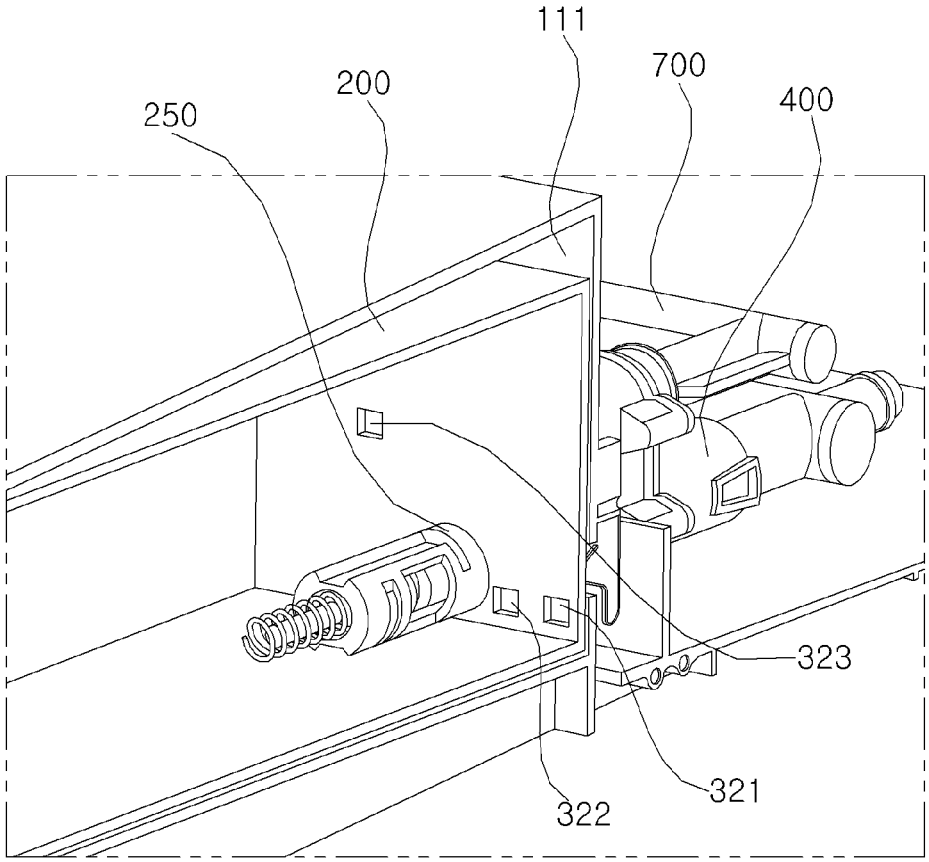
FIG. 10 is a view showing an interior of a cartridge and an electrode sensor shown in FIG. 8.
Figure 11:
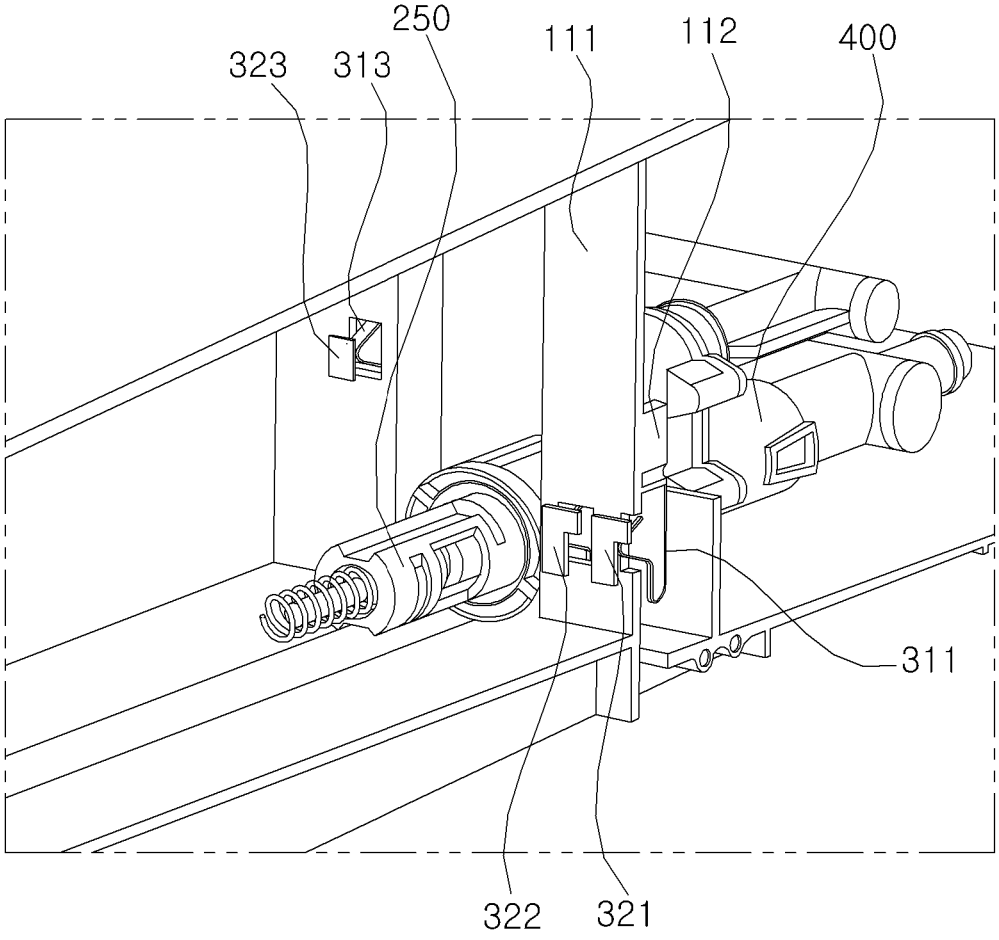
FIG. 11 is a view showing a shape of an electrode plate of the electrode sensor shown in FIG. 10.
Figure 12:
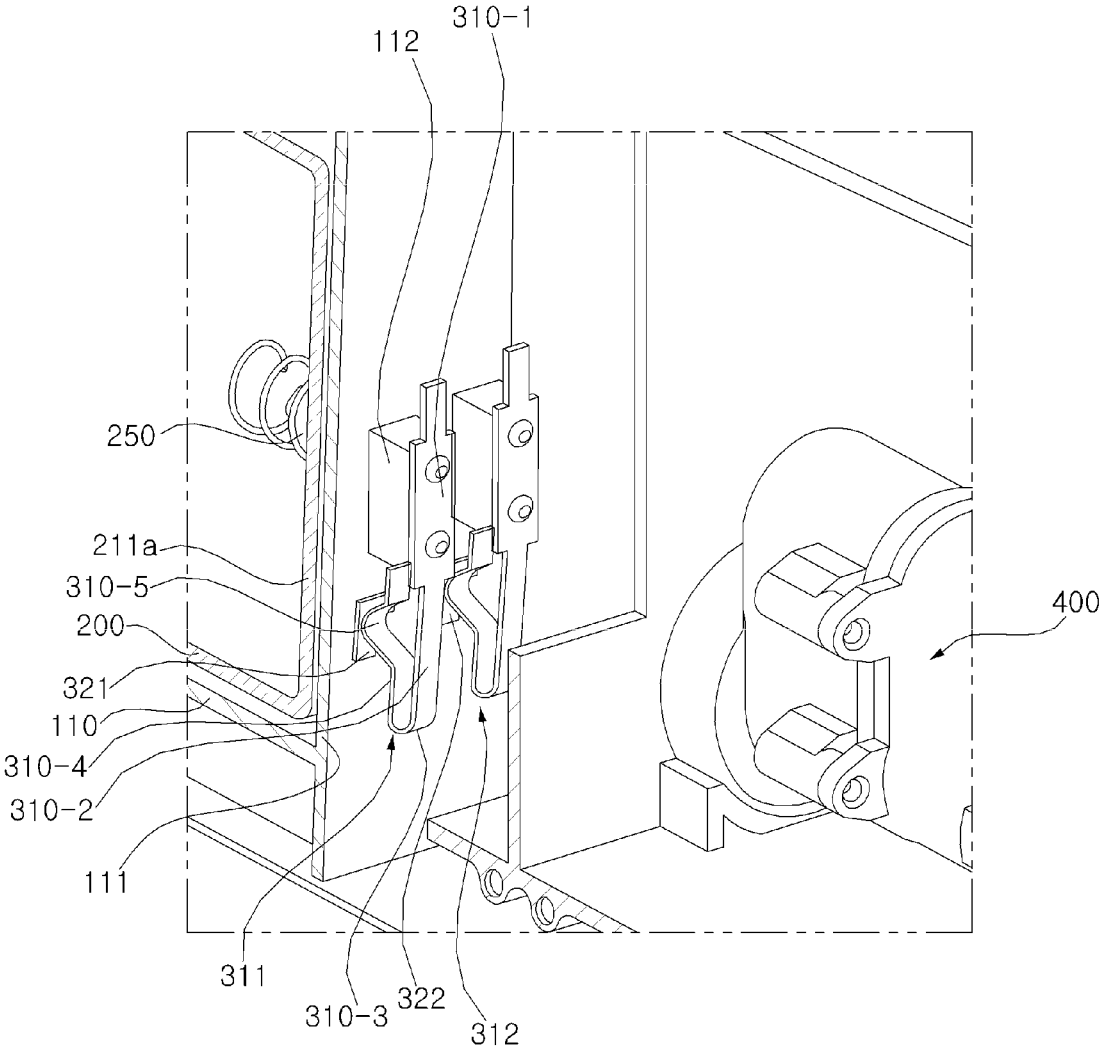
FIG. 12 is a view showing a rear surface of a cartridge housing and a terminal of an electrode sensor.
Figure 13:
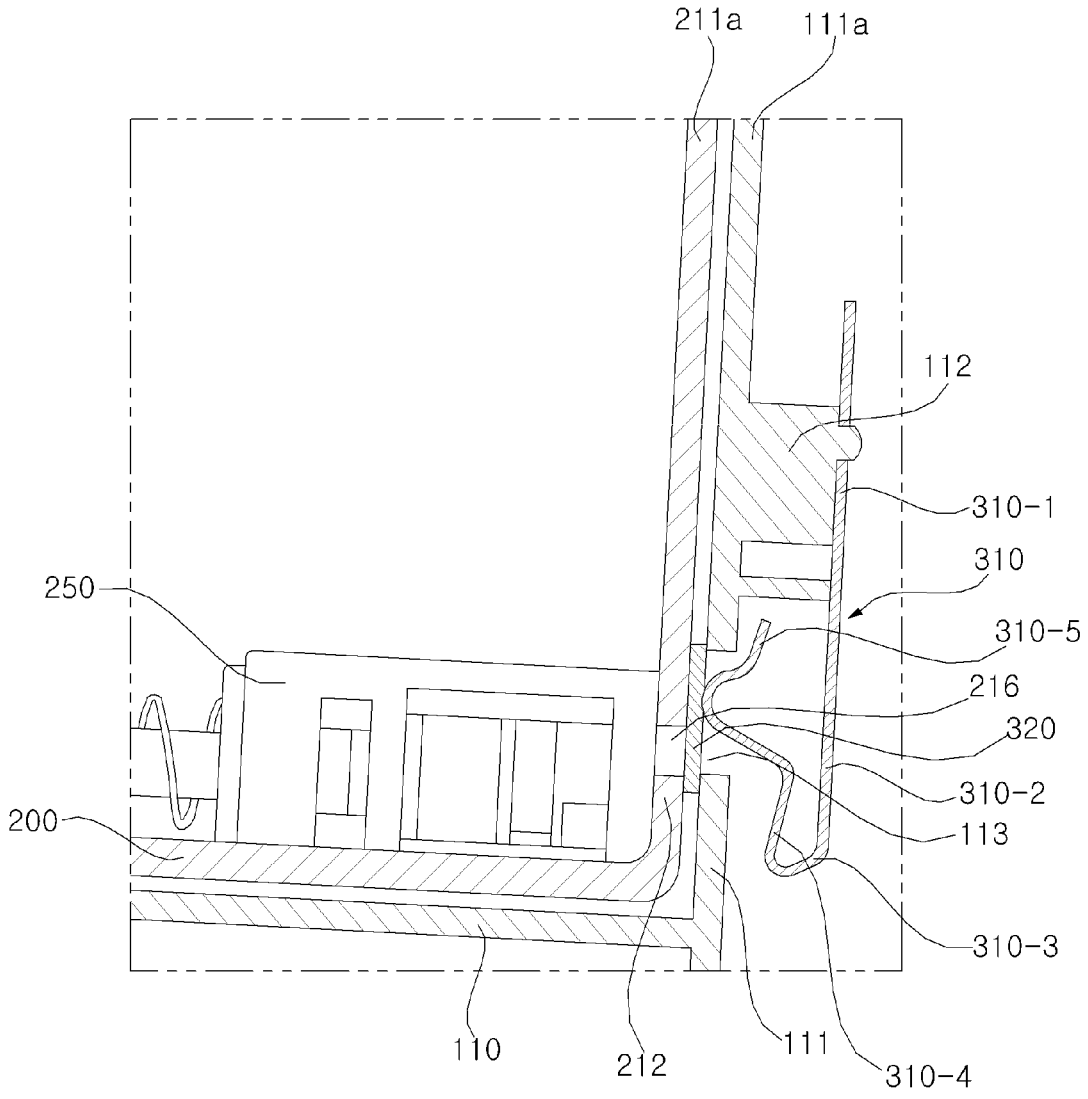
FIG. 13 is a cross-sectional view of a cartridge and a cartridge housing, and shows an electrode plate and a terminal.
Figure 14:
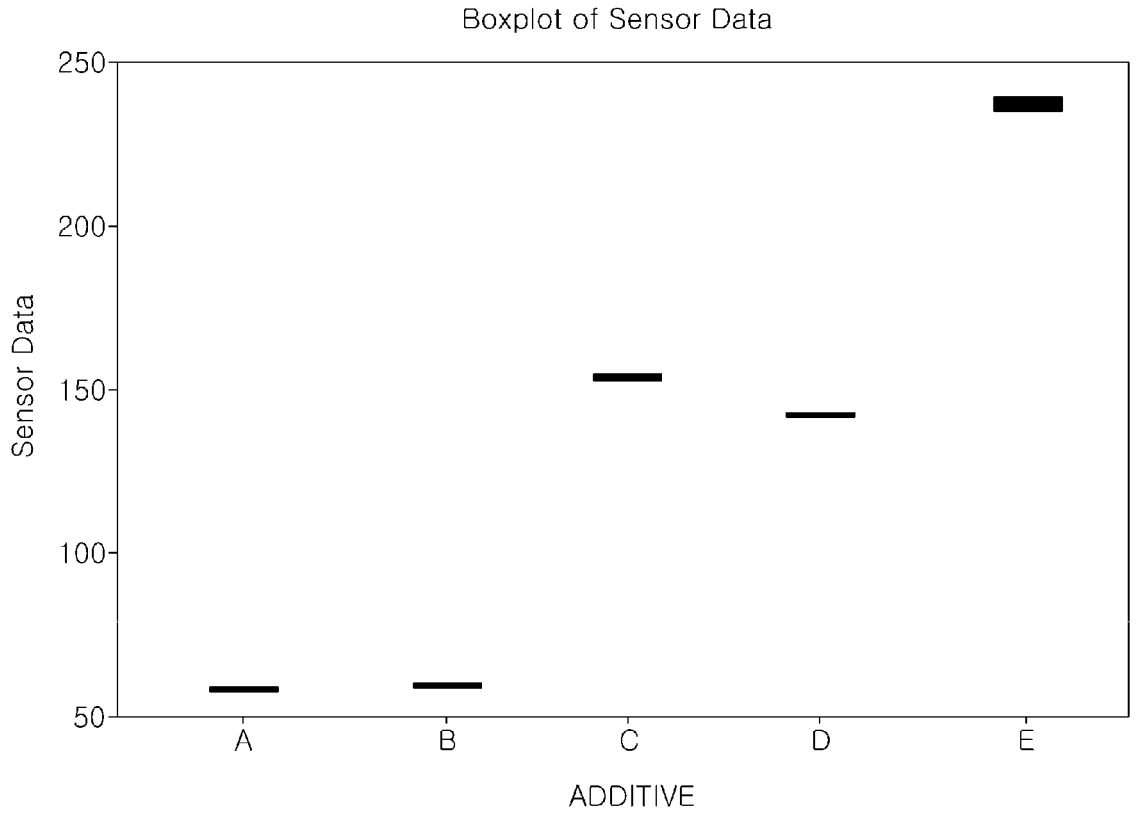
FIG. 14 is a graph showing a voltage applied to an electrode sensor according to the type of additive.
Figure 15:
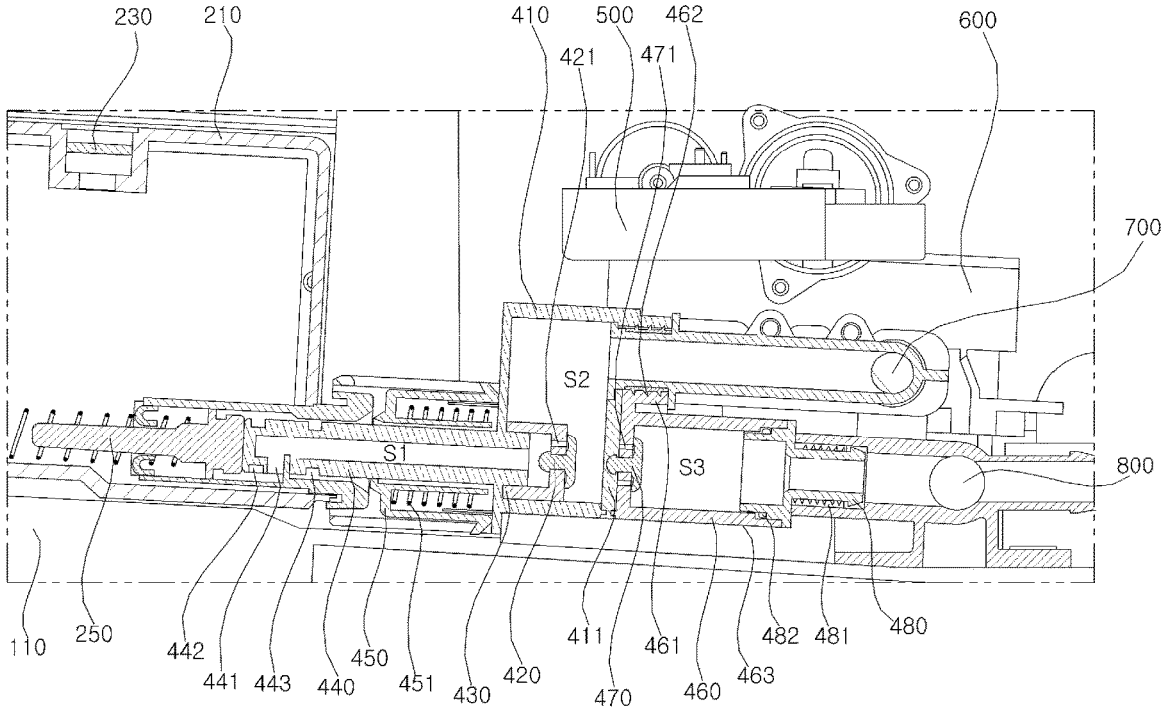
FIG. 15 is a cross-sectional view of a check valve assembly shown in FIG. 8.
Figure 16:
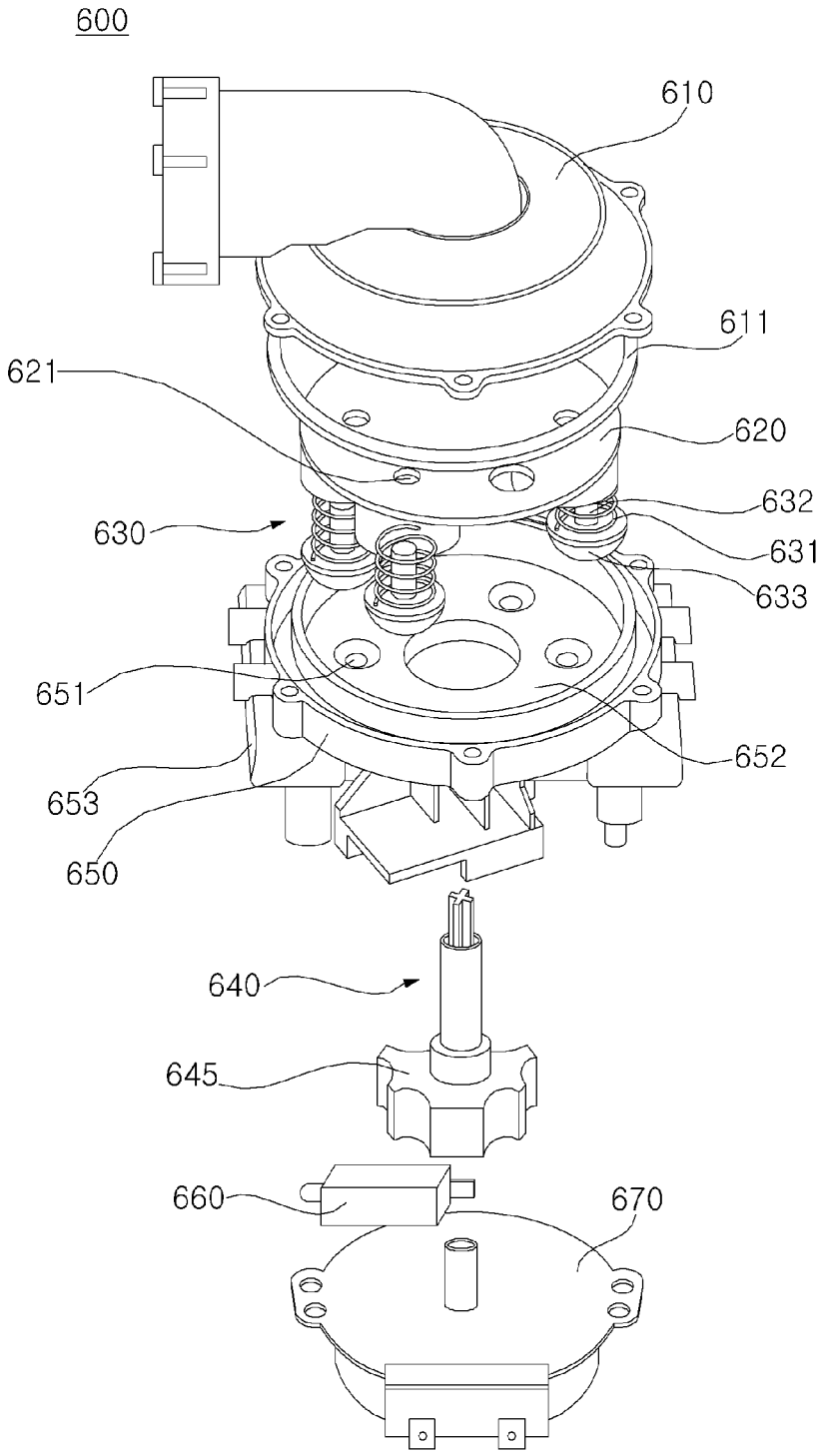
FIG. 16 is an exploded perspective view of a flow path switching valve shown in FIG. 8.
Figure 17:
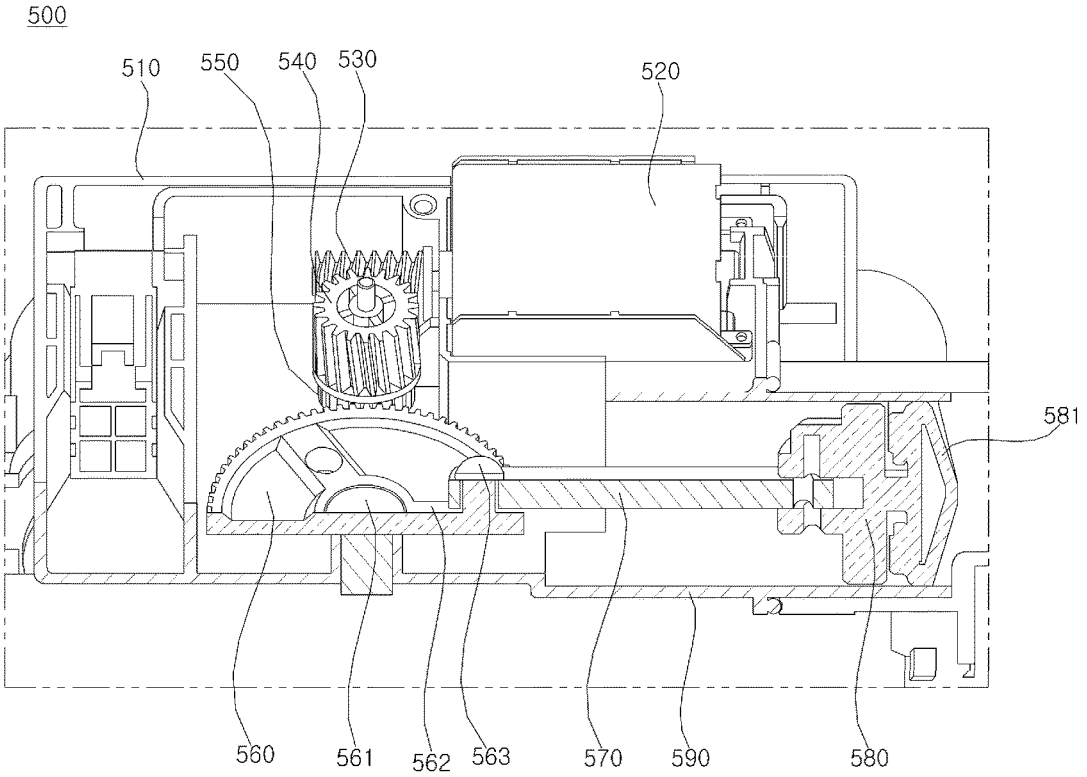
FIG. 17 is a view showing a pump shown in FIG. 8.
Figure 18:
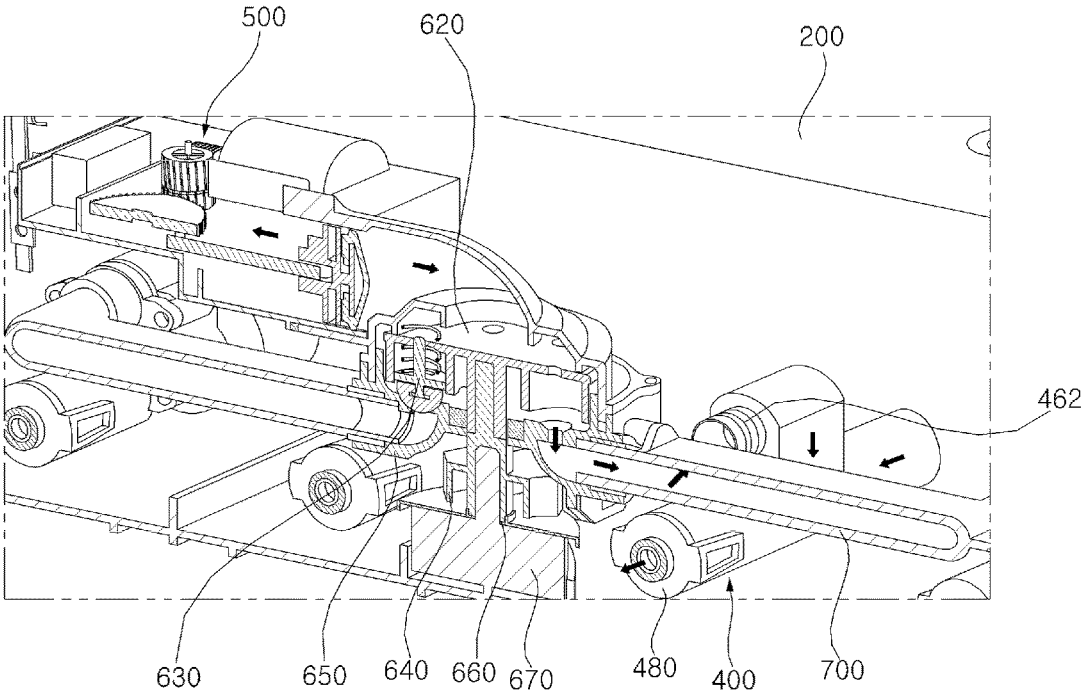
FIG. 18 is a view showing that a changed pressure is transmitted through a flow path switching valve according to the driving of the pump shown in FIG. 8.
Figure 19:
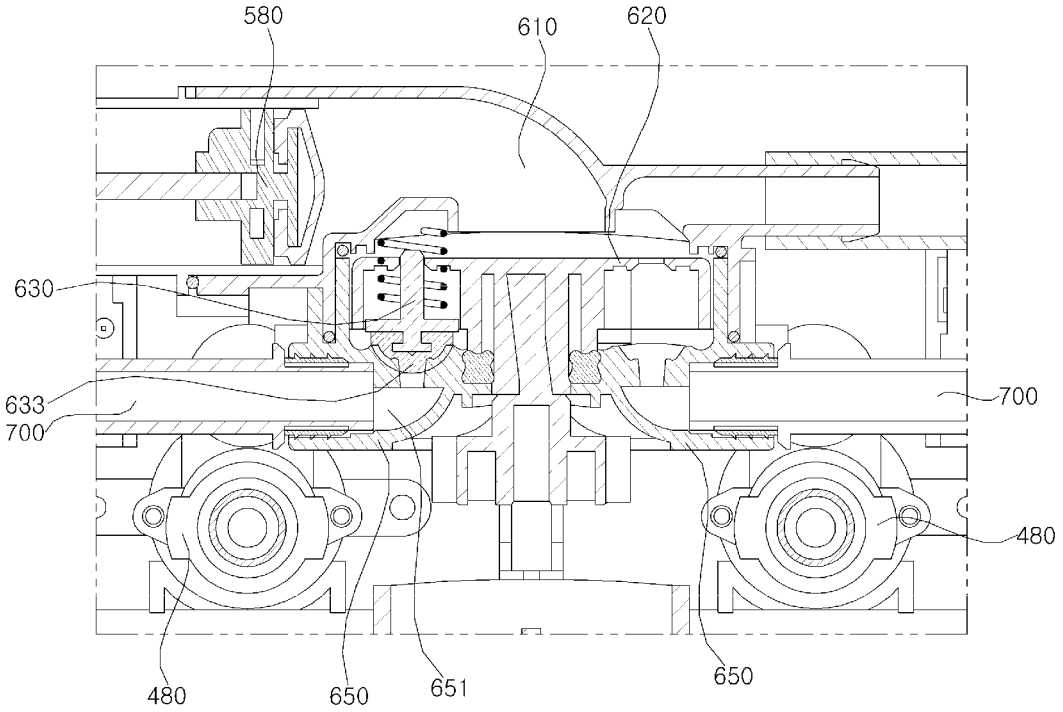
FIG. 19 is a sectional view of a flow path switching valve.

FIG. 10 is a view showing the interior of the cartridge 200 in the state where the cartridge 200 is installed in the cartridge housing 110, FIG. 11 is a view showing that the cartridge 200 of FIG. 10 is removed to show the shape of the electrode plate 320, FIG. 12 is a perspective view showing the rear surface of the cartridge housing 110, FIG. 13 shows an electrode plate 320 and a terminal 310in the state where the cartridge 200 is installed in the cartridge housing 110, and FIG. 14 is a graph showing a voltage applied to an electrode sensor according to the type of additive.

The electrode sensor 300 is installed in the cartridge 200 and the cartridge housing 110. The electrode sensor 300 includes an electrode plate 320 installed in the cartridge and a terminal 310 installed in the cartridge housing.

A plurality of electrode sensors 300 are provided. The plurality of electrode sensors 300*a*, 300*b*, 300*c*, 300*d*, 300*e*, and 300*f* are installed in the plurality of cartridges 200*a* to 200*f* and a position facing the plurality of cartridges 200*a* to 200*f* of the cartridge housing 110. In the embodiment of the present disclosure, the electrode sensors 300*a*, 300*b*, 300*c*, 300*d*, 300*e*, 300*f*, (hereinafter, 300) are respectively formed in correspondence with six cartridges 200*a*, 200*b*, 200*c*, 200*d*, 200*e*, 200*f*.

The electrode sensor 300 includes a plurality of electrode plates 320*a*, 320*b*, 320*c*, 320*d*, 320*e*, 320*f* respectively installed in the plurality of cartridges 200*a* to 200*f*, and a plurality of terminals 310*a*, 310*b*, 310*c*, 310*d*, 310*e*, 310*f* respectively installed in a position facing the plurality of electrode plates 320*a*, 320*b*, 320*c*, 320*d*, 320*e*, 320*f* of the cartridge housing 110.

The electrode sensor includes at least two electrodes 301, 302. The two electrodes 301 and 302 are connected to a different pole of a power source to apply a current. The electrode sensor 300 may include first and second electrodes 301 and 302 that are relatively installed in the lower side, and a third electrode 303 that is installed in the upper side of the two electrodes 301 and 302. Thus, it is possible to detect whether a small amount of the additive or a large amount of the additive is accommodated in the cartridge 200.

The electrode sensor 300 outputs a signal, when the first and second electrodes 301 and 302, which are spaced apart from each other with positive (+) and negative (−) poles, are conducted through the medium. Therefore, when an additive is contained in the cartridge 200, the additive acts as a medium to allow current to flow, and the conductivity varies according to the type of the additive, so that the type of the additive can be determined based on the current value or voltage value detected by the electrode sensor 300.

The first electrode 301*a*, 301*b*, 301*c*, 301*d*, 301*e*, 301*f* (hereinafter, 301), the second electrode 302*a*, 302*b*, 302*c*, 302*d*, 302*e*, 302*f* (hereinafter, 302), and the third electrode

303*a*, 303*b*, 303*c*, 303*d*, 303*e*, 303*f* may be installed in each cartridge 200 and a position of the cartridge housing 110 facing thereto.

The first electrode 301 includes a first electrode plate 321*a*, 321*b*, 321*c*, 321*d*, 321*e*, 321*f* (hereinafter, 321) and a first terminal 311*a*, 311*b*, 311*c*, 311*d*, 311*e*, 311*f* (hereinafter, 311). Similarly, the second electrode 302 includes a second electrode plate 322*a*, 322*b*, 322*c*, 322*d*, 322*e*, 322*f* (hereinafter, 322) and a second terminal 312*a*, 312*b*, 312*c*, 312*d*, 312*e*, 312*f* (hereinafter, 312), and the third electrode 303 includes a third electrode plate 323*a*, 323*b*, 323*c*, 323*d*, 323*e*, 323*f* (hereinafter, 323), and a third terminal 313*a*, 313*b*, 313*c*, 313*d*, 313*e*, 313*f* (hereinafter, 313).

Hereinafter, since the plurality of electrode sensors 300*a* to 300*f* are the same except that they are installed in different cartridges, the electrode sensor 300*a* which is installed in any one cartridge 200*a* of the plurality of cartridges 200*a* to 200*f* and the cartridge housing 110 facing thereto will be described.

The electrode plate 320 is installed in the rear surface of the cartridge 200, and an electrode plate through hole 216 may be formed in the rear surface 212 of the cartridge 200. The electrode plate 320 is installed in a position where the electrode plate through hole 216 is formed to block the electrode plate through hole 216. One surface of the electrode plate 320 faces the inside of the cartridge, and the other surface opposite to the one surface is installed to face the outside of the cartridge. One surface of the electrode plate 320 may contact the additive contained in the cartridge 200, and the other surface may be installed to be exposed to the outside of the cartridge 200.

The electrode plate 320 is installed outside the rear surface 212 of the cartridge 200. The first and second electrode plates 321 and 322 are installed in parallel at the same height in the rear surface 212 of the cartridge 220, and the third electrode plate 323 is installed at the higher height than the first and second electrode plates 321 and 322 in the rear surface 212 of the cartridge.

An electrode plate through hole 216 is formed in the rear surface of the cartridge 200 so that the additive contained in the cartridge 200 may contact the electrode plate 320 installed outside the rear surface of the cartridge 200. When the additive is contained inside the cartridge 200, the additive may contact the electrode plate through the electrode plate through hole 216, and conduction of electric current may occur through the additive contacting the electrode plate.

The electrode plate 320 is installed in close contact with the outside of the rear surface 212 of the cartridge, so that the additive in the cartridge 200 does not leak between the electrode plate 320 and the rear surface 212.

The electrode plate through hole 216 is formed in an area where the lower portion of the electrode plate 320 is located. The terminal 310 may contact the upper portion of the electrode plate. The electrode plate through hole 216 may be installed at a higher position than a detergent inlet 441 formed in a docking pipe 440 described later.

The first and second electrode plates 321 and 322 may be formed respectively in a shape of reversed 'L'. The electrode plate 320 may have a lower width that is narrower than the upper width. Since the electrode plate 320 has a large upper width, it is easy to be in contact with the terminal 310, and signal transmission through this can be easily performed. As the width of the lower portion of the electrode plate 320 is formed smaller, the distance between the first and second electrode plates 321 and 322 increases and the possibility of interference between the first and second electrode plates 321 and 322 decreases.

The terminal 310 is installed in the cartridge housing 110. The cartridge housing 110 is provided with a cartridge connection wall 111 facing the rear surface of the cartridge 200. The terminal 310 is installed in the cartridge connection wall 111. The terminal 310 is installed in a position facing the electrode plate 320, and may contact the electrode plate when the cartridge 200 is seated on the cartridge housing 110. More specifically, the cartridge connection wall 111 is provided with a connection wall protrusion 112 protruding in the opposite direction of the cartridge 200, and the terminal 310 is fixedly installed in the connection wall protrusion 112. The cartridge connection wall 111 is provided with a connection wall opening 113 where a part of the terminal is located.

The terminal includes a connection portion 310-1 coupled to the cartridge housing 110 (i.e. the connection wall protrusion 112), a first extension portion 310-2 extended from one side of the connection portion 310-1, a first bent portion 310-3 bent to the opposite side from the first extension portion, a second extension portion 310-4 extended from the first bent portion 310-3, and a second bent portion 310-5 bent toward the cartridge from the second extension portion. The first extension portion 310-2 may be extended downward from the connection portion 310-1, the first bent portion 310-3 may be bent upward from the first extension portion 310-2, and the second extension portion 310-4 may be extended upward from the first bent portion 310-3. At least a portion of the second bent portion 310-5 may be located in the connection wall opening 113 and may be in contact with the electrode plate 320.

Based on such a structure, when the cartridge 200 is seated on the cartridge housing 110, the terminal 310 may contact the electrode plate 320 while pushing the electrode plate 320. The terminal 311 may receive an electrical signal from the electrode plate 321. The signal transmitted to the terminal 311 may be transmitted to the controller 3 through a wire.

The terminal 310 is formed of a thin metal plate, and a screw hole is formed in the connection portion 310-1 to be screwed with the connection wall protrusion 112.

According to an embodiment of the present disclosure, the first electrode 301 and the second electrode 302 may be provided in one side based on the docking valve 250, and the third electrode 303 may be provided in the other side.

The third electrode plate 323 has a difference in installation height from the first and second electrode plates 321 and 322. In addition, the third electrode plate 323 is spaced apart from the first and second electrode plates 321 and 322 in the left-right direction, the docking valve 250 is disposed between the third electrode plate 323 and the first and second electrode plates 312 and 323. Therefore, unlike the first and second electrode plates 321 and 322, the third electrode plate 323 may not be formed in a reversed 'L' shape.

Meanwhile, the electrode sensor 300 detects the type of additive contained in the cartridge 200. The electrode sensor 300 detects the conductivity of the additive, and the controller 3 may determine the type of the additive from the detected value of the electrode sensor 300. The controller 3 may apply a current to the electrode sensor 300, and the electrodes (e.g. first and second electrodes 301 and 302) of the electrode sensor 300 may be electrically connected to each other by an additive contained in the cartridge 200. The additive serves as a resistance, and resistance or conductivity is varied according to the type of the additive. Therefore, when a current is applied to the electrode sensor 300, the electrode sensor 300 may detect a different voltage value according to the type of additive contained in the cartridge 200.

In FIG. 14, the x-axis indicates the type of the additive, and the y-axis indicates the voltage value detected by the electrode sensor 300 according to the type of the additive. A is a general detergent, B is a wool detergent, C is a nonionic detergent, D is a state in which the fabric softener is contained in the cartridge 200, and F is a state in which no additive is contained in the cartridge 200. In a circuit diagram in which the voltage of 0 to 5V is applied to the electrode sensor 300, the y-axis indicates that the voltage applied to the electrode sensor is replaced with 8-bit data.

As described above, there are various types of additives, and even the additive of the same type may have a different component and a composition ratio according to manufacturer. However, even if the manufacturers are different, the additive of the same type may have the same role acting on the laundry, so that the contained component and the composition ratio of the components may be similar. Thus, additive of the same type manufactured by a different manufacturer may have a similar level of electrical conductivity or resistance.

Depending on the type of additive, the voltage detected by the electrode sensor 300 is measured multiple times to display the measured range on a graph, and calculate an average value. Depending on the type of additive, average values of 57.6 for general detergent A, 59 for wool detergent B, 153.6 for nonionic detergent C, and 142 for fabric softener D are calculated. In the case where the detergent is not contained in the cartridge 200, an average value of 238 greater than these is calculated. In addition, it can be seen that the deviation of the non-ionic detergent is greater in comparison with the general detergent A, the wool detergent B, and the fabric softener D. It can be seen that the cartridge containing no additive, the deviation is larger.

As shown in FIG. 14, the additive has a different conductivity depending on its type, and the conductivity can be detected through the electrode sensor 300 to determine the type of additive contained in the cartridge 200. The voltage is determined according to the conductivity of the additive, and the conductivity of the additive can be calculated from the applied current and the detected voltage. Therefore, in an embodiment of the present disclosure, a voltage is detected by applying a current to the electrode sensor 300, but the electrode sensor 300 can be considered as detecting the conductivity of the additive.

Meanwhile, referring to FIG. 4, information on additive may be stored in the memory 4. In the memory 4, conductivity data according to the type of the additive may be pre-stored, and as conductivity data according to the type of the additive, data on a voltage applied to the electrode sensor may be stored.

In addition, the conductivity value of the additive detected by the electrode sensor 300 may be stored in the memory 4. The conductivity data of the additive detected by the electrode sensor 300 may be a value for voltage.

The controller 3 may determine the type of additive contained in the cartridge 200 from the detection value of the electrode sensor. The controller 3 may determine the type of the additive by comparing the detection value of the electrode sensor with data of the conductivity of the additive stored in the memory.

In the memory 4, the controller 3 may store data for determining the type of additive that is contained in each cartridge 200.

The display unit 6 may display what additives are contained in the cartridge 200. The display unit 6 may display the type of additive contained in each of the plurality of cartridges 200. A user can easily recognize the type of additive that is contained in each cartridge 200 through the display unit 6.

The washing machine according to the embodiment of the present disclosure may exchange data with a certain server S through the communication unit 7. The communication unit 7 may communicate with the certain server S using known WiFi technology.

Information on the additive input by a designer is stored in the certain server S, and the communication unit 7 may transmit the detection value of the electrode sensor to the certain server S. Thus, the certain server S may receive the detection value of the electrode sensor from the washing machine to which WiFi is connected, and build big data.

The communication unit 7 may receive data related to the conductivity of the additive from the certain server S. The controller 3 may update the memory 4 based on data related to the conductivity of the additive received from the certain server S. Thus, the latest data can be stored in the memory 4, and the controller 3 can enhance the accuracy of determining the additive type.

Hereinafter, the structure of the check valve assembly 400 will be described with reference to FIGS. 5 to 8 and 15.

The plurality of check valve assemblies 400 are respectively connected to the plurality of cartridges 200 to control the extracting of the additive. In the check valve assembly 400, a space S2 in which the extracted additive is temporarily stored is formed. In the space S2 formed in the check valve assembly 400, the pressure from the pump 500 is changed, and thus, the additive contained in the cartridge is extracted to the space S2.

The check valve assembly 400 may include a first check valve housing 410*a*, 410*b*, 410*c*, 410*d*, 410*e*, 410*f* (hereinafter, 410) which forms a space S2 in which the additive extracted from the cartridge 200 is temporarily stored, a first check valve installed in the first check valve housing 420*a*, 420*b*, 420*c*, 420*d*, 420*e*, 420*f* (hereinafter, 420), a second check valve housing 460*a*, 460*b*, 460*c*, 460*d*, 460*e*, 460*f* (hereinafter, 460) which is in communication with the first check valve housing 410 and connected to each of a plurality of check valve connection pipes 850 provided in an outlet flow path 800, and a second check valve 470 installed in the second check valve housing 460.

In addition, the check valve assembly 400 may include a check valve cap 430*a*, 430*b*, 430*c*, 430*d*, 430*e*, 430*f* (hereinafter, 430) which prevents additive and air from leaking through the first check valve 420, and a docking pipe 440*a*, 440*b*, 440*c*, 440*d*, 440*e*, 440*f* (hereinafter, 440) which is coupled to the docking valve 250 of the cartridge 200 and can move the additive of the cartridge 200 in the direction of the check valve.

A first discharge hole 421 communicating with the cartridge 200 may be formed in the first check valve housing 410. The space S2 inside the first check valve housing 410 communicates with the cartridge 200 by a space S1 formed in a docking pipe described later and the first discharge hole 421.

The first check valve 420 opens and closes the first discharge hole 421 to control the extracting of the additive from the cartridge 200 to the space S2 of the first check valve housing. When the first check valve 420 is separated from the peripheral portion of the first discharge hole 421 of the first check valve housing 410 to open the first discharge hole 421, the additive contained in the cartridge 200 is extracted to the space S2 of the first check valve housing. When the first check valve 420 is in contact with the peripheral portion of the first discharge hole 421 of the first check valve housing 410 to close the first discharge hole 421, the additive contained in the cartridge 200 is not extracted to the space S2 of the first check valve housing.

The first check valve housing 410 includes an inlet flow path connection portion 461*a*, 461*b*, 461*c*, 461*d*, 461*e*, 461*f* (hereinafter, 461) connected to an inlet flow path. The inlet flow path connection portion 461 is tightly coupled to an inlet flow path 700 through an inlet flow path connection plug 462*a*, 462*b*, 462*c*, 462*d*, 462*e*, 462*f* (hereinafter, 462). The plurality of check valve assemblies 400 are respectively connected to the plurality of flow paths 700*a*, 700*b*, 700*c*, 700*d*, 700*e*, 700*f* of the inlet flow path 700 described later through the inlet flow path connection portion 461.

Meanwhile, in the first check valve housing 410, the opposite side where the first discharge hole is formed is open, the second check valve housing 460 having the inlet flow path connection portion 461 is coupled to the opened portion, so that the check valve assembly 400 and the inlet flow path 700 may be connected.

The docking pipe 440 is provided with a detergent inlet 441*a*, 441*b*, 441*c*, 441*d*, 441*e*, 441*f* (hereinafter 441) into which additive supplied from the cartridge 200 flows through the docking valve 250, a flow path (hereinafter, also referred to as a space S1) communicating with the detergent inlet 441 is formed inside the docking pipe 440.

When the cartridge 200 is separated from the cartridge accommodating space of the housing 110, the docking valve 250 is closed, and when it inserted into the cartridge accommodating space, the docking valve 250 is pushed by the docking pipe 440 to be opened, so that the additive contained in the cartridge 200 flows into the inner space S1 of the docking pipe through the detergent inlet 441.

In the docking pipe 440 where the detergent inlet is interposed, a first docking pipe O-ring 442*a*, 442*b*, 442*c*, 442*d*, 442*e*, 442*f* (hereinafter, 442) and a second docking pipe O-ring 443*a*, 443*b*, 443*c*, 443*d*, 443*e*, 443*f* (hereinafter, 443) are inserted into and installed in a first docking pipe O-ring groove 442*a*-1, 442*b*-1, 442*c*-1, 442*d*-1, 442*e*-1, 442*f*-1 (hereinafter, 442-1) and a second docking pipe O-ring groove 443*a*-1, 443*b*-1, 443*c*-1, 443*d*-1, 443*e*-1, 443*f*-1 (hereinafter, 443-1). This is to prevent the additive from leaking outside when the additive enters the detergent inlet.

The check valve assembly 400 may include a docking pipe circumferential portion 450*a*, 450*b*, 450*c*, 450*d*, 450*e*, 450*f* (hereinafter, 450) coupled to the docking valve 250 around the docking pipe. The docking pipe circumferential portion 450 is provided with a docking pipe spring 451*a*, 451*b*, 451*c*, 451*d*, 451*e*, 451*f* (hereinafter, 451), the coupling between the check valve assembly 400 and the docking valve 250 is secured through the elastic force of the docking pipe spring, and when the cartridge 200 is separated from the housing 110, it can be more easily separated due to elastic force.

Between the first check valve housing 410 and the second check valve housing 460, a check valve o-ring 411*a*, 411*b*, 411*c*, 411*d*, 411*e*, 411*f* (hereinafter, 411) is inserted and install so that the first check valve housing 410 and the second check valve housing 460 are connected and, at the same time, sealed to prevent air from leaking. Alternatively, the first check valve housing 410 and the second check valve housing 460 may be integrally formed.

The second check valve housing 460 is provided with a second discharge hole 471 communicating with the space S2 of the first check valve housing. The second check valve housing 460 is coupled to an outlet flow path connection pipe 480 to form a space S3 therein.

The outlet flow path connection pipe 480 may be integrally formed with the second check valve housing 460, or separately provided to be coupled to the second check valve housing. The outlet flow path connection pipe 480 is coupled to a check valve connection pipe 850 of the outlet flow path 800 to communicate the space S3 of the second check valve housing 460 with the outlet flow path 800.

The outlet flow path connection pipe 480 is coupled to an outlet flow path connection portion 463 formed in a distal end of the second check valve housing 460, and is firmly coupled to the second check valve housing 460 by the outlet flow path connection O-ring 482*a*, 482*b*, 482*c*, 482*d*, 482*e*, 482*f* (hereinafter, 482). The outlet flow path connection pipe is tightly coupled to the check valve connection pipe 850 of the outlet flow path 800 by the outlet flow path connection plug 481*a*, 481*b*, 481*c*, 481*d*, 481*e*, 481*f* (hereinafter, 481).

The second check valve 470 opens and closes the second discharge hole 471 to control of the discharge of the additive from the space S2 of the first check valve housing to the space S3 of the second check valve housing. When the second check valve 470 is separated from the peripheral portion of the second discharge hole 471 of the second check valve housing 460 to open the second discharge hole 471, the additive temporarily stored in the space S2 of the first check valve housing can be discharged to the space S3 of the second check valve housing. When the second check valve 470 contacts the peripheral portion of the second discharge hole 471 of the second check valve housing 410 and closes the second discharge hole 471, the additive temporarily stored in the space S2 of the first check valve housing is not discharged into the space S3 of the second check valve housing.

The first check valve 420 may be disposed to open the first discharge hole 421, in the inside S2 of the first check valve housing 410, and the second check valve 470 may be disposed to open and close the second discharge hole 471, in the inside S3 of the second check valve housing 460. The first check valve 420 and the second check valve 470 may be installed to be opened in the same direction.

This is because when two check valves are installed to be opened in different directions, it is impossible to form a negative pressure in the second space S2 so as to extract the additive. Among the first check valve 420 and the second check valve 470 according to the embodiment of the present disclosure, it is possible that the first check valve 420 is opened only to the second space S2, and the second check valve 470 is opened only to the third space S3.

The first and second check valves 420 and 470 have a circular hemispherical shape and use an elastic rubber material. One end of the first and second check valves 420 and 470 is formed of a protrusion portion 423, 473 to be fitted into the first and second discharge holes 422 and 472 formed in the center of the first and second discharge holes 421 and 471. The other end of the first and second check valves 420 and 470 is formed of a hemisphere portion 424 and 474 having a hemispherical shape, so that a flat surface of the hemisphere portion may be seated in the first and second discharge surfaces 425 and 475 where the first and second discharge holes 421 and 471 are formed.

The distal end of the protrusion portion 423 and 473 is formed to be thicker than the middle, and the distal end of the protrusion portion 423 and 473 is caught in the rear surface of the first and second discharge holes 422 and 472 so that the first and second check valves 420, 470 are fixed to the first and second discharge holes 421 and 471.

When the pressure of the fluid through a piston 580 described later is transmitted in the direction of the hemisphere portion 424 and 474 of the first and second check valves 420 and 470, the flat portion of the hemisphere portion 424 and 474 is in close contact with the first and second discharge holes 421 and 471 that are in contact with each other due to the pressure of the fluid, thereby closing the first and second discharge holes. Therefore, the additive cannot enter the inlet or outlet flow path 700, 800 through the closed first and second discharge holes.

On the other hand, when the pressure of the fluid through the piston 580 is transmitted in the direction of the protrusion portion 423 and 473 of the first and second check valves 420 and 470, the flat portion of the hemisphere portion 424 and 474 is separated from the first and second discharge holes 421 and 471 that are in contact with each other due to the air pressure to open the first and second discharge holes. Therefore, the additive may enter the inlet or outlet flow path 700, 800 through the opened first and second discharge holes. This is because the first and second check valves 420 and 470 are formed of an elastic material, the shape and position of the protrusion portion 423 and 473 and the hemisphere portion 424 and 474 may be changed by negative pressure or positive pressure.

According to an embodiment of the present disclosure, the first and second check valves 420 and 470 may be formed of rubber. Since the first and second check valves 420 and 470 formed of an elastic material can be manufactured in a compact size in comparison with a check valve using a conventional spring, a structure such as a spring length and a shaft supporting the spring is not required so that the check valve can be miniaturized, and the size of the second space S2 formed through the check valve can be reduced.

However, the first and second check valves 420 and 470 are not limited to the above-described structure, and may be the above-described conventional check valves having an elastic plug, a spring, and a spring shaft.

On the other hand, when the piston 580 of the pump 500 described later reciprocates within a cylinder, a space S2 of the first check valve housing should be formed with a volume equal to or greater than the reciprocating volume formed inside the cylinder. This is because when the piston reciprocating volume inside the cylinder exceeds the volume of the first check valve housing space S2, the additive may overflow into the inlet or outlet flow path 700, 800 described later.

In addition, the outlet flow path connection pipe 480 connected to the outlet flow path 800 is formed in a lower position than the first discharge hole 421 which connects the space S1 of the docking pipe and the space S2 of the first check valve assembly to discharge the additive in the space S1 of the docking pipe into the space S2 of the first check valve assembly, and the second discharge hole 471 that connects the space S2 of the first check valve assembly and the space S3 of the second check valve assembly to discharge the additive in the second space S2 into the third space S3. Therefore, the additive that passed through the first and second discharge holes 421 and 471 can be more properly flowed into the outlet flow path 800 due to the potential energy.

Hereinafter, the operation of the check valve assembly 400 will be described with reference to FIGS. 20A to 20C.

Figure 20A:
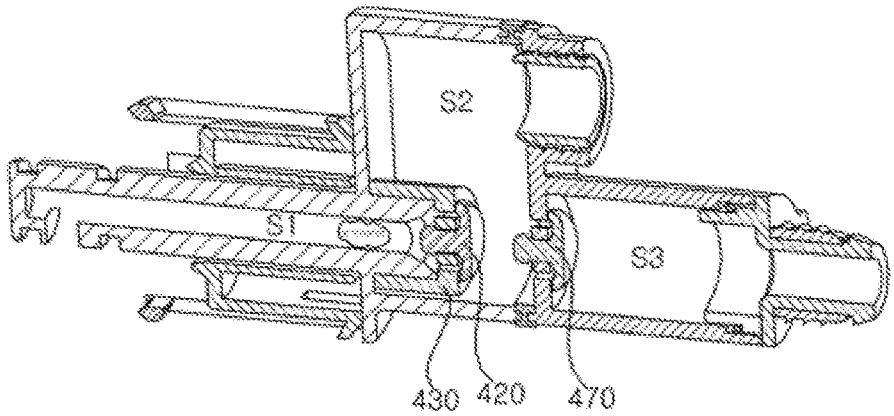
FIGS. 20A to 20C are operation state diagrams showing that the additive is extracted through a check valve.

FIG. 20A shows the state in which a cartridge 200 is inserted into the cartridge accommodating space and is coupled to the check valve assembly 400, and the additive (or detergent) is accommodated in the cartridge 200 and the inner space S1 of the docking pipe before the pump 500 is operated.

Figure 20B:
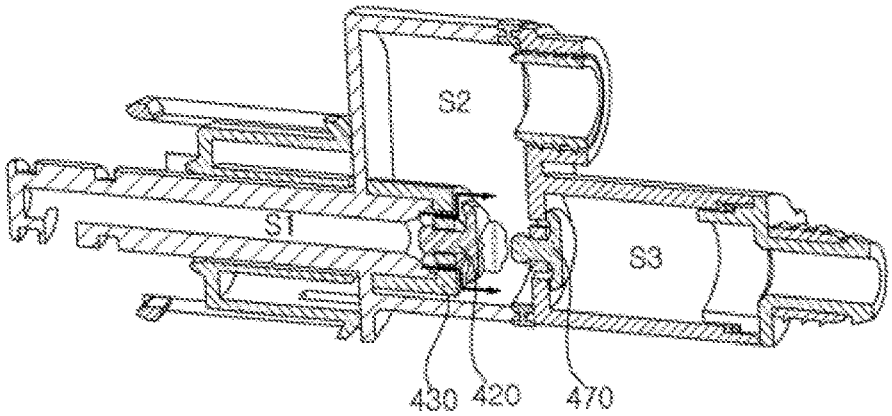

FIG. 20B shows a state in which the pressure in the space S2 of the first check valve housing 410 is decreased due to the retraction of the piston 580. The pressure is decreased in the space S2 of the first check valve housing 410, so that the first check valve 420 is opened and detergent is extracted into the space S2 of the first check valve housing 410, and the second check valve 470 is closed so that detergent is temporarily stored in the space S2 of the first check valve housing 410.

Figure 20C:
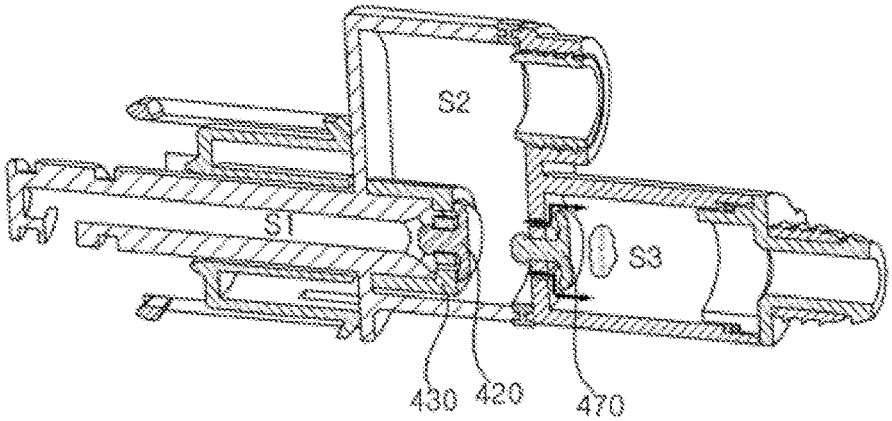

FIG. 20C shows a state in which the pressure in the space S2 of the first check valve housing 410 is increased as the piston 580 moves forward. The pressure is increased in the space S2 of the first check valve housing 410, so that the first check valve 420 is opened, and the second check valve 470 is closed. Accordingly, the additive temporarily stored in the first check valve housing 410 is discharged to the space S3 of the second check valve housing 460.

The negative pressure or positive pressure generated by the forward/rearward movement of the piston 580 provided in the pump 500 is transmitted to the space S2 (hereinafter, also referred to as a second space) of the first check valve housing 410 through the inlet flow path 700.

When the piston 580 moves forward toward the inlet flow path 700 in the cylinder, the first check valve 420 closes the first discharge hole, and the second check valve 470 opens the second discharge hole 471. When the piston 580 moves rearward to the opposite side of the inlet flow path 700 in the cylinder, the first check valve 420 opens the first discharge hole 421, and the second check valve 470 closes the second discharge hole 471.

According to an embodiment of the present disclosure, the piston 580 moves rearward, and thus, the generated negative pressure is transmitted to the second space S2 through the inlet flow path 700. Therefore, the first check valve 420 is opened by the negative pressure applied to the second space S2. In addition, the additive inside the cartridge 200 enters the second space S2 via the first check valve 420 through the space S1 (hereinafter, also referred to as a first space) of the docking pipe 440 due to the negative pressure applied to the second space S2.

When the additive enters the second space S2, the piston 580 moves forward, and thus, the generated positive pressure is transmitted to the second space S2 through the inlet flow path 700 again. Therefore, the second check valve 470 is opened by the positive pressure applied to the second space, and the first check valve 420 is positioned while being blocked. Therefore, the additive in the second space S2 is supplied to the space S3 (hereinafter, also referred to as a third space) of the second check valve housing 460, due to positive pressure applied to the second space S2. The additive supplied to the third space S3 may be discharged to the outlet flow path 800 by positive pressure applied to the second space S2 and the third space S3, and may be supplied to the tub 31 or a drawer 39 together with supplied water.

As described above, the check valve according to the embodiment of the present disclosure is designed to effectively transmit the pressure change due to the piston reciprocating motion when discharging the additive in a container by applying the pressure change due to the piston motion, two first and second check valves 420 and 470 are used to discharge additive during reciprocating motion of the piston, in order to move the liquid according to the pressure change.

Hereinafter, the structure and operation of the pump 500 will be described with reference to FIGS. 5 to 8 and 17.

The detergent supply device 100 may include one or more pumps 500. The pump 500 may be provided in a number less than the number of cartridges 200.

The detergent supply device 100 includes a single pump 500 and a single flow path switching valve 600 to selectively extract the additive contained in the plurality of cartridges 200.

Alternatively, the detergent supply device 100 may include two or more pumps 500 and the flow path switching valve 600 having the same number as the pump 500.

For example, the detergent supply device 100 may include two first and second pumps 500 and two first and second flow path switching valves 600. The first pump may be connected to some cartridges (e.g., 200*a*, 200*b*, 200*c*) which are one or more of the plurality of cartridges 200*a*, 200*b*, 200*c*, 200*d*, 200*e*, 200*f* through the first flow path switching valve, can selectively extract the additive contained therein, and the second pump may be connected to the remaining part of the cartridges (e.g., 200*d*, 200*e*, 200*f*) through the second flow path switching valve, so that the additive contained therein can be selectively extracted.

Alternatively, the detergent supply device 100 may include two or more pumps 500 and fewer flow path switching valves 600 than the pumps 500.

For example, the detergent supply device 100 may include two first and second pumps 500 and a single flow path switching valve 600. The first pump is not connected to a flow path switching valve, but connected to any one cartridge (e.g., 200*a*) of the plurality of cartridges 200*a*, 200*b*, 200*c*, 200*d*, 200*e*, 200*f* so that the additive contained therein can be extracted. The second pump is connected to the remaining cartridges (e.g. 200*b*, 200*c*, 200*d*, 200*e*, 200*f*) through a flow path switching valve, so that the additive contained therein can be selectively extracted.

Meanwhile, a plurality of inlet flow paths 700 described later may also be provided. At least one inlet flow path 700 may include two or more flow paths respectively communicating with two or more check valve assemblies of the plurality of check valve assemblies 400.

The pump 500 may change the pressure of the space S2 formed in the check valve assembly 400 communicating with two or more flow paths of the inlet flow path 700 to extract additive, and the flow path switching valve 600 may selectively communicate the pump 500 with any one of two or more flow paths of the inlet flow path 700. The flow path switching valve 600 may communicate the cylinder 590 of the pump 500 with any one of two or more flow paths of the inlet flow path 700. When the pump is operated, the additive may be extracted to the space S2 formed in the check valve assembly in communication with the cylinder 590 and any one flow path.

Meanwhile, when the detergent supply device 100 includes a plurality of pumps 500, cartridges connected to different pumps may be classified and may guide a user to contain additive.

For example, it is known that general detergents and fabric softeners are easily hardened when mixing. Therefore, each cartridge can be marked so that the general detergent can be contained in any one of the cartridges connected to the first pump, and the fabric softener can be contained in any one of the cartridges connected to the second pump. In addition, since babies have weak skin, it is undesirable to mix bleach when washing baby clothes. Accordingly, each cartridge can be marked so that the baby clothes detergent can be contained in another of the cartridges connected to the first pump, and the bleach can be contained in the other of the cartridges connected to the second pump.

Hereinafter, the case where the detergent supply device 100 is provided with one pump 500 will be described as an example, but the number of the pumps 500 is not limited to one, and it is sufficient if at least one pump 500 is connected to two or more cartridges 200 through the flow path switching valve 600, the inlet flow path 700, and the check valve assembly 400.

The pump 500 may include a pump housing 510 for accommodating pump parts, a piston 580 for changing the pressure in the space S2 of the first check valve housing through the forward/rearward movement, a cylinder 590 forming a space for the piston to move forward and rearward, a motor 520 for generating power, a first gear 530 rotated by the motor 520, a second gear 540 rotating in engagement with the first gear, a third gear 550 rotates with the second gear 540, a crank gear 560 rotates in engagement with the third gear, and a connecting rod 570 connecting the crank gear and the piston.

The piston 580 may perform reciprocating motion in a direction parallel to the direction in which the plurality of cartridges 200 are arranged, and the motor 520 may have a drive shaft disposed parallel to the direction in which the piston 580 performs reciprocating motion.

For example, the cartridge 200 is formed long in the front-rear direction of the washing machine, a plurality of cartridges may be installed in a line in the left-right direction of the washing machine, and the piston 580 can perform reciprocating motion in the left-right direction of the washing machine. In addition, the motor 520 may be arranged such that the drive shaft is aligned in the left-right direction.

The first gear 530 may be coupled to the drive shaft of the motor 520 and may rotate integrally with the drive shaft. The first gear 530 may be formed of a helical gear. Through the helical gear, noise from the motor 520 can be reduced, and power transmission can be easily performed. The second gear 540 may be formed of a worm gear. Since the pump 500 is located between configurations such as the inlet, outlet flow paths 700 and 800, and the flow path switching valve 600, it is necessary to dispose the assembly accommodation space as densely as possible for efficient use of space. Therefore, according to the embodiment of the present disclosure, the motor 520 is laid down and the second gear 540 is formed of a worm gear so that the rotational power direction can be switched and transmitted.

The second gear 540 and the third gear 550 rotate together. The crank gear 560 rotates in engagement with the third gear 550. The number of gear teeth of the crank gear is formed much more than the number of gear teeth of the third gear 550, so that a stronger force can be transmitted due to the gear ratio during the reciprocating motion of the piston 580.

The crank gear 560 includes a crank shaft 561 forming a rotation axis of the crank gear, a crank arm 562 extended from the crank shaft, and a crank pin 563 connected to a connecting rod 570. The crank pin 563 and the connecting rod 570 are rotatably coupled, and when the crank gear 560 rotates, as the crank pin 563 rotates, the connecting rod 570 may move linearly in the direction that the cylinder 590 forms.

The connecting rod 570 is coupled to the piston 580, and the piston 580 is inserted into the cylinder 590 and can reciprocate in the longitudinal direction of the cylinder 590. Through the linear motion of the piston 580, positive or negative pressure may be transmitted to the flow path switching valve 600 connected to the cylinder 590. When the piston moves in the direction of the flow path switching valve 600, positive pressure is transmitted to the flow path switching valve 600, and when the piston moves in the opposite direction of the flow path switching valve 600, negative pressure is transmitted to the flow path switching valve 600.

Hereinafter, the flow path switching valve 600 will be described with reference to FIGS. 5 to 8, 16, 18 and 19.

The flow path switching valve 600 is connected to the pump 500 and the inlet flow path 700. The flow path switching valve 600 selectively communicates the cylinder 590 of the pump 500 with any one flow path 700 (e.g. 700*a*) of the plurality of flow paths of the inlet flow path 700.

As described later, a first outlet flow path 800*a* and a second outlet flow path 800*b* may be disposed to be spaced apart from each other in a direction in which the plurality of cartridges 200 are arranged. The flow path switching valve 600 may be disposed between a gap where the first and second outlet flow paths 800*a* and 800*b* are spaced apart.

The flow path switching valve 600 includes a first housing 610 connected to the cylinder 590 of the pump 500, a second housing 650 coupled with the first housing, a disk 620 rotatably disposed in a space formed by the first housing 610 and the second housing, a spring valve 630 installed in the disk 620, a flow path switching motor 670 for rotating the disc, a shaft 640 for transmitting the rotational force of the flow path switching motor 670 to the disk 620, a micro switch 660 for inputting the rotational position of the disk 620 to the controller 3, and a plane cam 645 that rotates with the shaft 640 and opens and closes the current flowing through the micro switch 660.

The first housing 610 may form an upper outer shape of the flow path switching valve 600, and the second housing 650 may form a lower outer shape of the flow path switching valve 600. Accordingly, the first housing 610 may be referred to as an upper housing 610, and the second housing 650 may be referred to as a lower housing 650.

The spring valve 630 includes a spring 631 that provides elastic force, a spring shaft 632 that prevents the spring 631 from being separated, and a plug part 633 that can block a flow path connection hole 651*a* by the elastic force of the spring.

The disk 620 is provided with an insertion hole 621 into which the spring shaft 632 is inserted so as to fix the position of the spring valve, and a disk hole 622 through which the fluid passes. The fluid introduced into the flow path switching valve 600 may pass through the disk 620 through the disk hole 622, and may partially pass through the insertion hole 621.

The second housing 650 is provided with a plurality of inlet connection ports 653*a*, 653*b*, 653*c*, 653*d*, 653*e*, 653*f* (hereinafter, 653) coupled to a plurality of flow paths of the inlet flow path 700, and a plurality of flow path connection holes 651*a*, 651*b*, 651*c*, 651*d*, 651*e*, 651*f* (hereinafter, 651) communicating with a plurality of inlet connection port 653 respectively. The fluid that passed through the disk hole 622 and the insertion hole 621 of the disk 620 may pass through each inlet connection port 653 through the flow path connection hole 651 and then may be supplied to each inlet flow path 700 connected to the inlet connection port 653.

The spring valve 630 may selectively open and close some of the plurality of flow path connection holes 651. When the disk 620 rotates and the spring valve 630 closes some of the plurality of flow path connection holes 651, the other may be opened.

In order to supply a plurality of additive, a plurality of flow path connection holes 651*a* may be opened, and a plurality of spring valves 630 may also be formed to block a plurality of flow path connection holes.

The spring valve 630 may be provided in a smaller number than the plurality of flow path connection holes 651, and preferably, may be provided in one less number than the number of the plurality of flow path connection holes 651. That is, the spring valve 630 may be provided in one less number than the number of the plurality of cartridges. In this case, one flow path connection hole 651 (e.g. 651*a*) may be opened, and the other flow path connection holes 651 (e.g. 651*b* to 651*f*) may be closed. Accordingly, the additive may be extracted from the cartridge 200*a* and discharged into the outlet flow path 800 by changing the pressure of the space S2 formed in the check valve assembly 400*a* connected to one cartridge (e.g. 200*a*) of the plurality of cartridges 200.

When the additive to be supplied is selected, power is supplied to the flow path switching motor 670 to be driven. The driven flow path switching motor 670 rotates the shaft 640 connected thereto and the disk 620 connected to the shaft 640.

At this time, the spring valve 630 installed in the disk 620 can also rotate together according to the rotation of the disk. When the flow path connection hole 651 of the lower housing 650 is located in the rotational position of the spring valve 630, the flow path connection hole 651 may be blocked by the plug part 633 due to the elastic force of the spring 631.

In order to connect the pump 500 and the check valve assembly 400*a* connected to the cartridge 200*a* containing the additive to be supplied, the controller 3 may control the rotation angle of the disk 620 so that the spring valve 630 is not located in the flow path connection hole 651*a* connected to the check valve assembly 400*a*.

If the spring valve 630 is not located in the flow path connection hole 651*a*, the pump 500 and the flow path connection hole 651*a* are opened, and positive or negative pressure generated in the pump 500 is sequentially transmitted to the inlet flow path 700*a* and the check valve assembly 400*a* through the flow path connection hole 651*a*, so that the additive of the cartridge 200 can be supplied to the outlet flow path 800.

In addition, in order to block the pump 500 and the check valve assembly 400*a* connected to the cartridge containing the additive that do not need to be supplied, the spring valve 630 is located in the flow path connection hole 651*a* connected to the check valve assembly 400*a*, and the rotation angle of the disk can be controlled so that the plug part 633 blocks the flow path connection hole 651*a* due to the elastic force of the spring 631.

When the spring valve 630 is located in the flow path connection hole 651*a*, the pump 500 and the flow path connection hole 651*a* are blocked, and positive or negative pressure generated in the pump 500 is not transmitted to the check valve assembly 400*a*, so that the additive of the cartridge 200 does not flow.

When the spring valve 630 of the disk 620 is not in the position of the flow path connection hole 651*a*, the spring valve 630 is located while being compressed in a lower housing upper surface 652, and then, when the spring valve 630 moves to the position of the flow path connection hole 651*a* through the rotation of the disk 620, the spring valve 630 is tensioned to block the flow path connection hole 651*a*.

In order to accurately control the rotation angle of the disk 620, the flow path switching valve 600 includes a micro switch 660 and a plane cam 645. The plane cam 645 may be integrally formed with the shaft 640 or coupled to the shaft 640 to rotate integrally with the shaft 640 and the disk 620.

The micro switch 660 includes an actuator, and an electric circuit can be changed by the movement of the actuator.

A cam is a device having a special contour (or groove) that performs a rotation movement (or reciprocating motion), and the plane cam 645 is a type of the cam, and refers to a contour indicating a plane curve.

Figure 8:
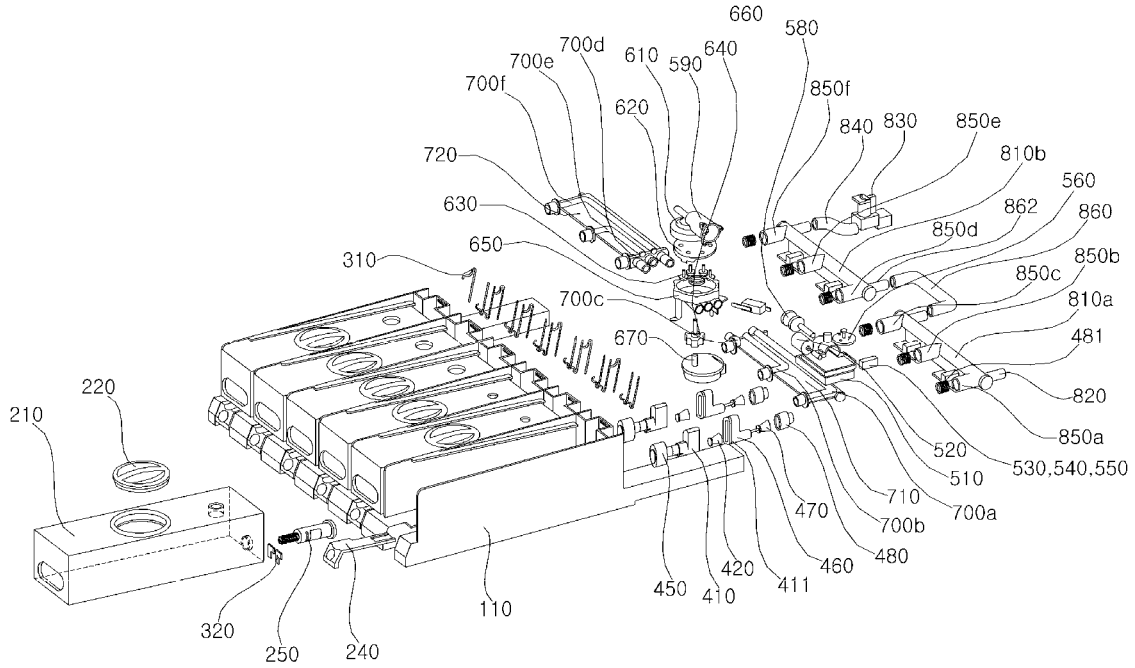
FIG. 8 is an exploded perspective view of the detergent supply device shown in FIG. 5.
Figure 9:
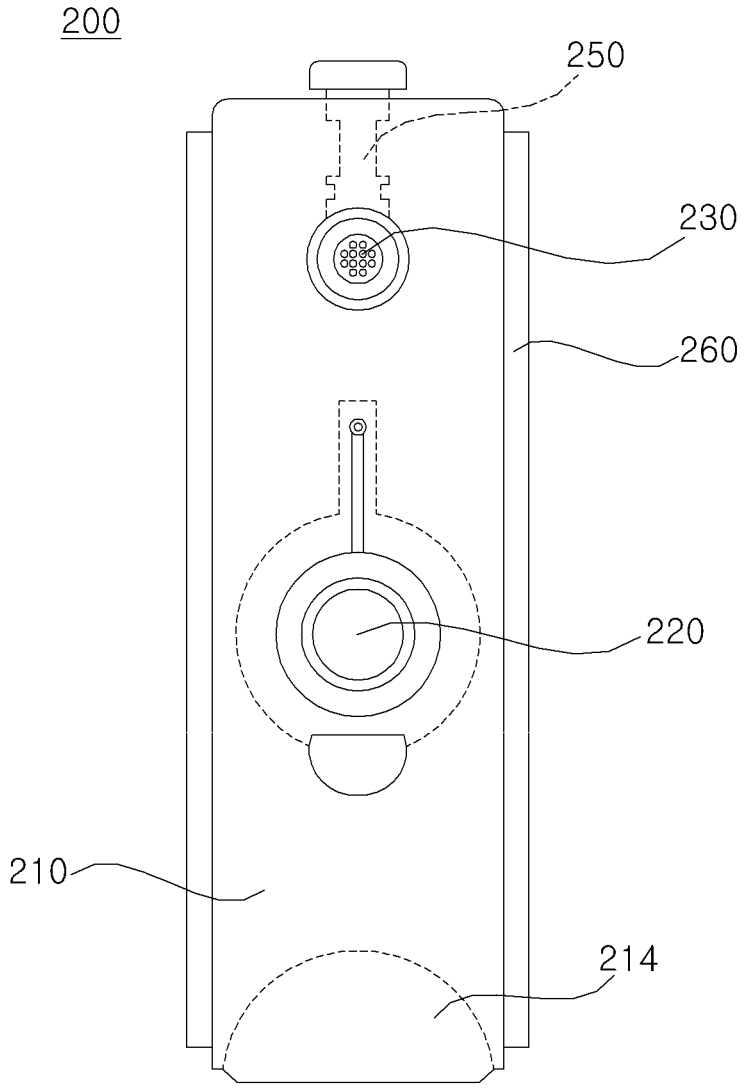
FIG. 9 is a plan view of a cartridge shown in FIG. 7.

Referring to FIGS. 8 and 12, the plane cam 645 forms a special contour by having a plurality of protrusion portions having different shapes and a separation distance, and as the plane cam 645 rotates, the protrusion portion can open and close the current by pressing the actuator provided in the micro switch 660. The controller 3 may determine and control the rotational position of the disk 620 due to a pattern in which the current is opened and closed.

The plane cam 645 and the shaft 640 rotate in combination with the drive shaft of the flow path switching motor, and the micro switch 660 is disposed such that the actuator contacts the plane cam 645. In an embodiment of the present disclosure, the flow path switching motor 670 is disposed below the lower housing 650, and the plane cam 645 and the micro switch 660 may be located between the flow path switching motor 670 and the lower housing 650.

Hereinafter, the inlet and outlet flow paths 700 and 800 will be described with reference to FIGS. 5 to 8.

The detergent supply device 100 includes an inlet flow path 700 that transmits the pressure change generated by the reciprocating motion of the piston 580 to the space S2 formed in the plurality of check valve assemblies 400. The inlet flow path 700 includes a plurality of flow paths 700*a*, 700*b*, 700*c*, 700*d*, 700*e*, 700*f* (hereinafter, 700*a*) communicating with the space S2 formed in the plurality of check valve assemblies 400 respectively.

The check valve assembly 400 of the inlet flow path 700 is connected to the flow path connection portion 461, and is connected to the inlet connection port 653 of the flow path switching valve 600 to transmit the flow of the fluid transmitted through the pump 500 to the check valve assembly 400.

The plurality of flow paths 700*a* are connected to a plurality of inlet flow path connection portions 461*a*, 461*b*, 461*c*, 461*d*, 461*e*, 461*f*, and inlet connection ports 653*a*, 653*b*, 653*c*, 653*d*, 653*e*, 653*f* respectively.

The inlet flow path 700 may include a first inlet flow path having a portion 700*a*, 700*b*, 700*c* of the plurality of flow paths 700*a*, 700*b*, 700*c*, 700*d*, 700*e*, 700*f*, and a second inlet flow path having a remaining portion 700*d*, 700*e*, 700*f* of the plurality of flow paths 700*a*, 700*b*, 700*c*, 700*d*, 700*e*, 700*f*.

Meanwhile, three cartridges 200 and a check valve assembly 400 connected thereto may be disposed respectively in the left and right sides, and the flow path switching valve 600 may be located in the center of the rear side of the cartridge.

The first inlet flow path 710 and the second inlet flow path 720 may be coupled with the flow path switching valve 600, and may be symmetrically coupled with respect to a straight line passing through the center of the flow path switching valve 600.

The flow path 700*a*, 700*b*, 700*c* provided in the first inlet flow path 710 may be respectively connected to the inlet flow path connection portion 461*a*, 461*b*, 461*c* of the left check valve assembly 400*a*, 400*b*, 400*c* and the flow path discharge holes 653*a*, 653*b*, 653*c* formed side by side in the left side of the flow path switching valve 600.

The flow path 700*d*, 700*e*, 700*f* provided in the second inlet flow path 720 may be respectively connected to the inlet flow path connection portion 461*d*, 461*e*, 461*f* of the right check valve assembly 400*d*, 400*e*, 400*f*, and the flow path discharge hole 653*d*, 653*e*, 653*f* formed side by side in the right side of the flow path switching valve 600.

The first inlet flow path 710 is integrally formed through a first flow path plate 715 to fix a plurality of flow paths 700*a*, 700*b*, 700*c*, and the second inlet flow path 720 is integrally formed through a second flow path plate 725 to fix a plurality of flow paths 700*d*, 700*e*, 700*f*, thereby stably supplying the fluid.

Meanwhile, in the outlet flow path 800, the water supplied from the water supply valve 830 and the additive extracted from the cartridge 200 flow. The outlet flow path 800 includes a plurality of check valve connection pipes 850*a*, 850*b*, 850*c*, 850*d*, 850*e*, 850*f* (hereinafter, 850) which are respectively connected to a plurality of check valve assemblies 400.

The outlet flow path 800 may include a joint pipe 810*a*, 810*b* in which a flow path communicating with a plurality of check valve connecting pipes 850 is formed, and through which water supplied from the water supply valve 830 and additive extracted from the cartridge 200 flow, and a discharge port 820*a* which communicates with the flow path of the joint pipe 810*a*, 810*b* and is connected to the tub 31 to discharge the water and additive. In addition, the outlet flow path 800 may include a water supply port 820*b* which is connected to the water supply valve 830 to receive the water supplied from the water supply valve 830, and communicates with the flow path of the joint pipe 810*a*, 810*b*.

The outlet flow path 800 is connected to the outlet flow path connection pipe 481 of the check valve assembly 400, so that the additive discharged through the outlet flow path connection pipe 481 is supplied to the tub 31 or drawer 39 through the discharge hole 820.

The detergent supply device 100 includes a water supply valve 830 receiving water from an external water source, and the water supply valve 830 may be connected to a water supply port 820*b* through a water supply hose 840. The water supplied through the water supply valve 830 passes through the water supply hose 840 and is guided to the outlet flow path 800.

The water thus guided flows along the joint pipe 810*a*, 810*b* toward the discharge port 820*a* located in the opposite side of the water supply port 820*b*, and is supplied through the check valve connection pipe 850 to dilute the additive introduced into the outlet flow path 800 and be discharged together with the additive to the discharge port 820*b*.

The check valve connection pipe 850 protrudes from the joint pipe 810*a*, 810*b* toward the cartridge (e.g. toward the front), and the discharge port 820*a* and the water supply port 820*b* may protrude toward the rear from the joint pipe 810*a*, 810*b*.

The check valve connection pipe 850 is connected to each outlet flow path connection pipe 480, and the additive discharged from the outlet flow path connection pipe 480 may be introduced into the outlet flow path 800 through the check valve connection pipe 850.

The outlet flow path 800 may include the first outlet flow path 800*a*, the second outlet flow path 800*b*, and a connecting hose 860 which connects the first outlet flow path 800*a* and the second outlet flow path 800*b*.

The first outlet flow path 800*a* may include a portion 850*a*, 850*b*, 850*c* of the plurality of check valve connection pipes, the discharge port 820*a*, and the first joint pipe 810*a* having a flow path communicating therewith. The second outlet flow path 800*b* may include a remaining portion 850*d*, 850*e*, 850*f* of the plurality of check valve connection pipes, the water supply port 820*b*, and the second joint pipe 810*b* having a flow path communicating therewith.

The first outlet flow path 800*a* may include a first connection port 861 in communication with the first joint pipe 810*a*, and the second outlet flow path 800*b* may include a second connection port 862 in communication with the second joint pipe 810*b*. The connection hose 860 may be connected to the first connection port 861 and the second connection port 862.

The first outlet flow path 800*a* and the second outlet flow path 800*b* are disposed to be spaced apart from each other in a direction in which a plurality of cartridges 200 are arranged (e.g. the left and right direction of washing machine), and thus the flow path switching valve 600 may be disposed in a spaced gap between the first and second outlet flow paths 800*a*, 800*b*.

In order to prevent the interference between the outlet flow path 800 and the flow path switching valve 600 as much as possible, the connection hose 810 may be installed in a deflected shape such as u-shape to secure the installation space of the flow path switching valve 600.

Hereinafter, a water supply valve of a washing machine according to an embodiment of the present disclosure will be described with reference to FIGS. 5 to 8 and 21.

The water supply valve 830 of the washing machine according to an embodiment of the present disclosure is connected to the water supply port 820*b* provided in the outlet flow path 800 to supply water to the outlet flow path 800. The water supply valve 830 and the water supply port 820*b* are connected through the water supply hose 840. However, since the water supply valve 830 is not connected to the outlet flow path through the flow path switching valve 600, the inlet flow path 700, the check valve assembly 400, etc. it can be said that the water supply valve and the outlet path are directly connected.

The washing machine according to an embodiment of the present disclosure uses air as a fluid for driving the first and second check valves 420 and 470. The cylinder 590, the inlet flow path 700 are filled with air, and the air flows through the space S2 formed in the cylinder 590, the inlet flow path 700, and the check valve assembly 400 due to the reciprocating motion of the piston 580. Accordingly, the changed pressure is transmitted to the space S2 formed in the check valve assembly 400.

Figure 21A:
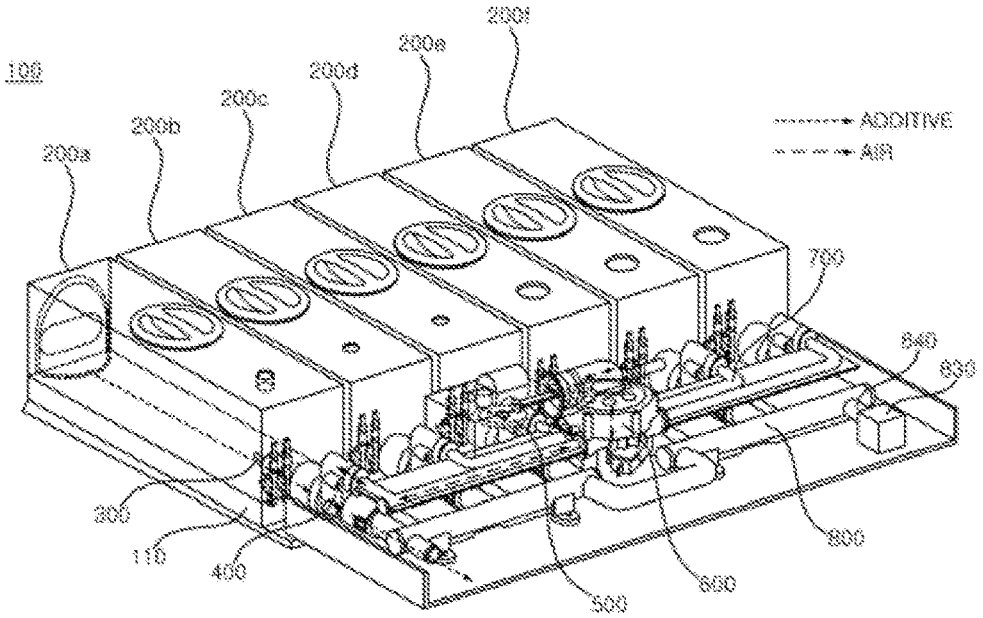
FIGS. 21A and 21B are views showing that additives, air, and water flow according to the driving of a pump of a washing machine according to an embodiment of the present disclosure.
Figure 21B:
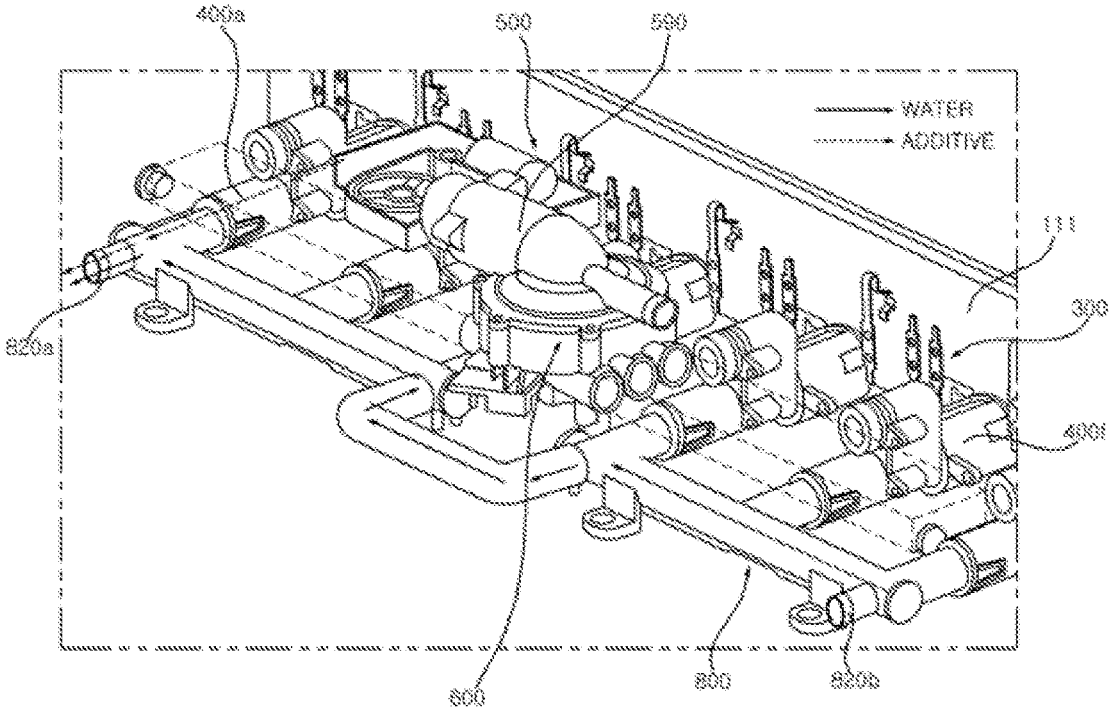

Referring to FIGS. 21A and 21B, through a flow path 700*a* communicating with the cylinder among the plurality of flow paths of the inlet flow path 700 by the flow path switching valve 600, in the pressure change due to the reciprocating motion of the piston 580, the pressure of the space S2 formed in the check valve assembly 400*a* communicating with the flow path 700*a*, among the plurality of check valve assemblies 400, is changed so that the additive is extracted from the cartridge 200*a* and discharged to the outlet flow path 800.

When the additive is discharged to the outlet flow path 800, the controller 3 opens the water supply valve 830 to supply water to the outlet flow path 800. Accordingly, the additive is added to the tub 31 or drawer 38 together with water.

Meanwhile, as described above, the water supply valve 830 of the washing machine may be connected to the flow path switching valve 600 or the pump 500 to supply water to the flow path switching valve 600 or the pump 500. The water supply valve 830 may not supply water directly to the outlet flow path 800, but may supply water to the outlet flow path through the flow path switching valve 600, the inlet flow path 700, and the check valve assembly 400. In this case, water is used as the fluid for driving the first and second check valves 420 and 470. The cylinder 590 and the inlet flow path 700 are filled with water, water flows between the space S2 formed in the cylinder 590, the inlet flow path 700, and the check valve assembly 400 by the reciprocating motion of the piston 580. Accordingly, the changed pressure is transmitted to the space S2 formed in the check valve assembly 400. In addition, the above-described water supply valve 820*b* is not formed in the outlet flow path 800, or the water supply valve 820*b* is sealed by a separate plug or the like.

Figure 22:
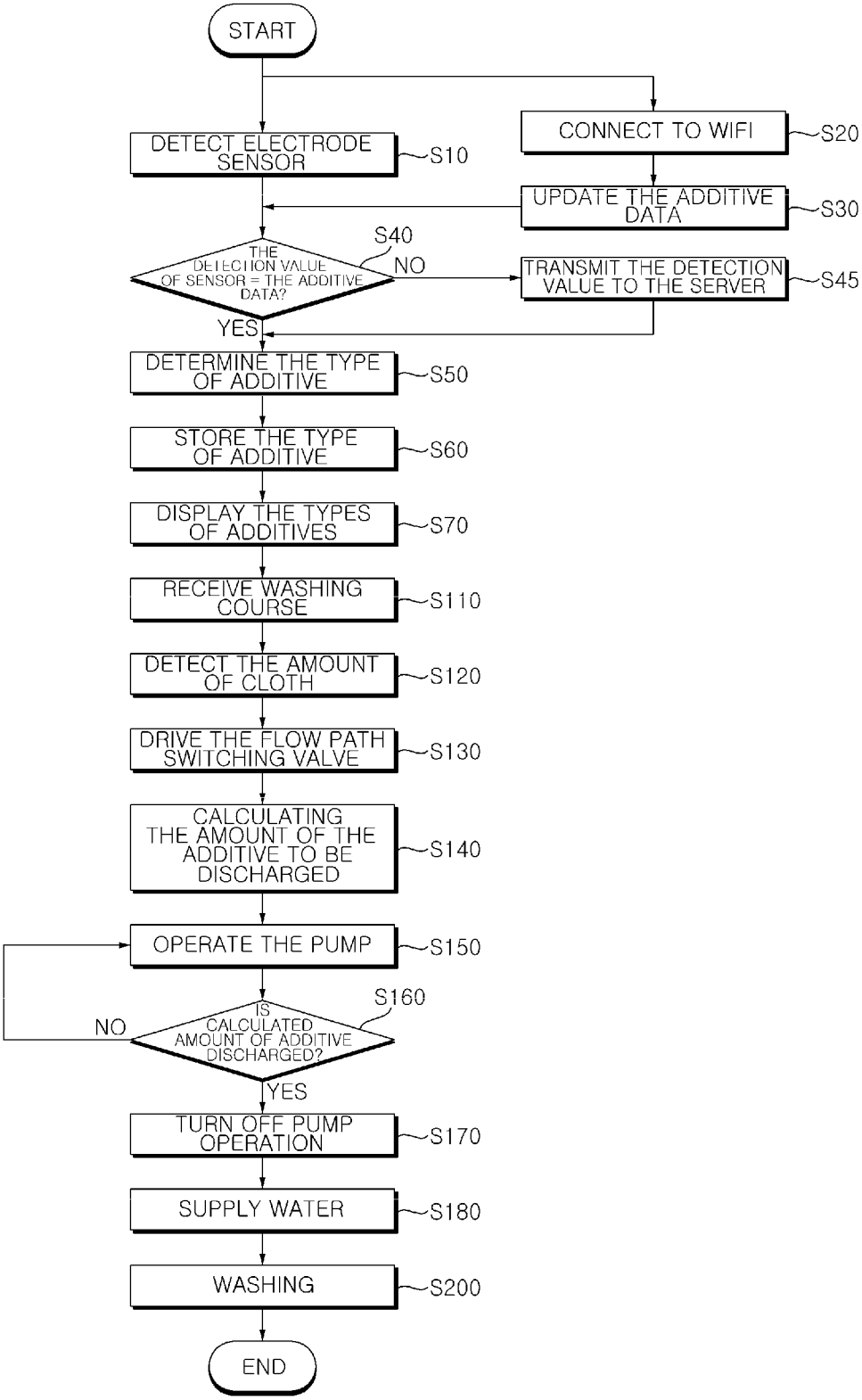
FIG. 22 is a flowchart illustrating a control method of a washing machine according to an embodiment of the present disclosure.

Hereinafter, a control method of a washing machine according to an embodiment of the present disclosure will be described with reference to FIGS. 22 and 23.

The control method of the washing machine according to an embodiment of the present disclosure includes a step S10 of detecting the conductivity of the additive contained in the plurality of cartridges 200 from the electrode sensor 300, a step S40 of comparing the detected conductivity value with data on the type of the additive previously stored in the memory 4, a step S50 of determining the type of additive contained in each of the plurality of cartridges 200, a step S110 of receiving a washing course through the input unit 5, a step S130 of selecting a preset additive according to the input washing course by the controller 3 after the step of receiving a washing course (S110) and the step (S50) of determining the type of additive, and a step S150, S160, S170 of extracting the selected additive by the pump 500. In addition, it may further include a step of receiving data according to the type of additive from a certain server S through the communication unit 7, and a step S30 of updating the data stored in the memory 4 based on the data received from the certain server S before the step of determining the type of the additive S40, S50. In addition, after the step of determining the type of the additive (S40, S50), it may further include a step S70 of displaying the types of additives contained in the plurality of cartridges 200 through the display unit 6.

When the washing machine is turned on, the controller 3 applies a current to the electrode sensor 300, and the electrode sensor 300 detects the conductivity of the additive contained in the cartridge 200 (S10). As described above, the electrode sensor 300 may detect the conductivity of the additive by using the voltage applied to the electrode. The controller 3 may store the value detected by the electrode sensor 300 in the memory 4.

Meanwhile, when the washing machine is turned on, the controller 3 may be connected to WiFi through the communication unit 7 (S20). When being connected to WiFi, the controller 3 may receive data according to the additive type from a certain server S, and update the data of the additive type stored in the memory 4 based on the received data (S30).

The controller 3 compares the conductivity value (or voltage value) detected by the electrode sensor 300 with the data of the type of the additive stored in the memory 4 (S40).

When the conductivity value detected by the electrode sensor 300 is the same as any one of data of the types of additives stored in the memory 4, the controller 3 determines the additive whose conductivity is detected as an additive of any one of the data. When the conductivity value detected from the electrode sensor 300 is different from all data on the type of additive stored in the memory 4, the additive whose conductivity is detected is determined as an additive of the data closest to the detected conductivity value (S50).

In addition, when the conductivity value detected from the electrode sensor 300 is different from all data on the type of additive stored in the memory 4, the controller 3 transmits the detected conductivity value to the certain server S through the communication unit 7 (S45). The certain server S may build big data using the conductivity value transmitted from the communication unit 7.

The controller 3 stores the data, which determines the type of the additive that is contained in each cartridge 200, in the memory 4 (S60). Based on this, afterwards, it is possible to control the flow path switching valve 600. In addition, the controller 3 may display the type of additive contained in each cartridge 200 through the display unit 6 (S70).

Meanwhile, when the washing machine is turned on, the controller 3 may receive a washing course from a user through the input unit 5 (S110). The controller 3 may receive the washing course after outputting the type of the additive to the display unit 6. Alternatively, when the washing machine is turned on, during the reception of the washing course (S110), the above mentioned S10 to S70 are performed, thereby reducing the waiting time of user.

When the washing course is inputted, the controller 3 may detect the amount of laundry accommodated in the drum through the current value obtained by rotating the washing motor (S120). Since the control method for detecting laundry is a known technology, a detailed description thereof will be omitted.

The controller 3 drives the flow path switching valve 600 to communicate the pump 500 with the check valve assembly 400*a* connected to the cartridge containing the preset additive according to the input washing course (S130). In the memory 4, not only the conductivity data according to the additive type, but also the type of additive to be input according to the washing course are preset, and the controller can select an additive to be input according to the received washing course.

After communicating the pump 500 with the check valve assembly 400*a*, the controller 3 may calculate the amount of the additive to be discharged according to the received washing course and the detected amount of laundry (S140). Unlike this, the controller 3 may detect the amount of laundry (S120), calculate the amount of the additive to be discharged (S140), and then drive the flow path switching valve 600 (S30). Alternatively, the driving (S130) of the flow path switching valve 600 and the calculation (S140) of the amount of additives to be discharged may be performed simultaneously.

The amount of additive to be input and the amount of water to be supplied are preset in the memory 4 according to the type of additive and the amount of laundry. In addition, the amount of the additive to be input may be stored as the operation time of the pump. The operation time of the pump 500 may be a value which is the amount of the additive to be input divided by the pumping capacity per unit hour of the pump. The controller 3 may discharge the additive contained in the cartridge 200 in communication with the pump 500 by a preset amount.

The controller 3 operates the pump (S150), maintains the pump operation during an operation time taken to discharge the calculated amount of the additive (S160), and stops the operation of the pump after the operation time is terminated (S170). Thus, the type and amount of the additive to be input can be automatically supplied to the washing machine.

An example will be described with reference to FIGS. 23A and 23B. FIG. 23A shows the amount of additives to be input, the unit may be, for example, ml. FIG. 23B shows a pump operation time in a second unit, when a pump pumping a fluid 150 ml per minute is used. The contents and numerical values shown in FIGS. 23A and 23B, such as the classification of additives, the classification of loads, the amount of additives to be input, and the pumping capacity of pump, are only exemplary values for understanding of the present specification and are not intended to limit the present disclosure.

The laundry load is determined by the amount of laundry. The laundry load of FIGS. 23A and 23B are divided into load 1 to load 5, and means that the amount of laundry increases as it progresses from load 1 toward load 5. Each additive may be input with a different amount for the same load, and as the load of any one type of additive becomes larger, greater amount may be input.

For example, when the input washing course is a washing course for inputting general detergent, and the detected amount of laundry corresponds to load 3, the amount of the additive to be input is 72 ml, and may be discharged by operating the pump having a pumping capacity of 150 ml for 29 seconds.

In this case, the controller 3 may operate the pump (S150), maintain the pump operation for 29 seconds (S160), and stop the pump operation after 29 seconds (S170).

When the additive is discharged by the calculated amount, the controller 3 opens the water supply valve 830 to supply water from an external water source to the outlet flow path 800 (S180).

As described above, the water supply valve 830 is connected to the water supply port 820*b* provided in the outlet flow path 800 to directly supply water to the outlet flow path. Alternatively, it may be connected to the water supply port 615 provided in the flow path switching valve 600 to supply water to the outlet flow path 800 through the flow path switching valve 600, the inlet flow path, and the check valve assembly 400.

Thereafter, the input washing course is performed (S200).

According to the washing machine and the control method of the washing machine of the present disclosure, there are one or more of the following effects.

First, it is possible to determine the type of additive contained in the cartridge by an electrode sensor that detects the conductivity of the additive contained in the plurality of cartridges, and the detected value of the electrode sensor.

Second, a controller that controls the operation of the detergent supply device, and a pump that extracts the additive contained in the cartridge are provided to automatically input appropriate additives according to a washing course.

Third, the controller can determine the type of additive from the detection value of the electrode sensor, and extract the additive contained in the cartridge through the pump. Therefore, even if a user inputs an arbitrary additive to a plurality of cartridges, appropriate additives can be added to the tub according to a washing course from among various types of additives contained in the plurality of cartridges.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a tub configured to receive water;

a drum provided inside the tub and configured to accommodate laundry therein;

a detergent supply device configured to supply an additive to the tub;

a controller configured to control the detergent supply device; and a memory, wherein the detergent supply device comprises:

a plurality of cartridges configured to contain the additive, a plurality of electrode sensors configured to detect conductivity of the additive contained in the plurality of cartridges, respectively, a pump configured to extract the additive contained in the plurality of cartridges, wherein the memory is configured to store conductivity data corresponding to a type of the additive to be stored in the plurality of cartridges, and wherein the controller is configured to:

compare the detected conductivity from at least one of the plurality of electrode sensors with the conductivity data stored in the memory, and determine, based on the detected conductivity corresponding to the conductivity data stored in the memory, the additive contained in the plurality of cartridges to be the corresponding type of the additive.

2. The washing machine of claim 1, wherein the detergent supply device further comprises a cartridge housing within which the plurality of cartridges are configured to be detachably arranged.

3. The washing machine of claim 2, wherein the plurality of electrode sensors comprise an electrode plate located in at least one of the plurality of cartridges, and wherein the electrode plate comprises a first surface that is configured to come in contact with the additive contained in the at least one of the plurality of cartridges.

4. The washing machine of claim 3, wherein the electrode plate further comprises a second surface that is opposite to the first surface and that is exposed to an outside of the plurality of cartridges, and wherein the plurality of electrode sensors further comprise a terminal that is located in the cartridge housing and that faces the second surface of the electrode plate.

5. The washing machine of claim 4, wherein the electrode plate is configured, based on the plurality of cartridges being arranged inside the cartridge housing, to make contact with the terminal.

6. The washing machine of claim 2, wherein the plurality of electrode sensors comprise:

a plurality of electrode plates that are located in the plurality of cartridges, respectively; and a plurality of terminals that are located in the cartridge housing and that face the plurality of electrode plates, respectively, and wherein, the plurality of electrode plates are configured, based on the plurality of cartridges being arranged inside the cartridge housing, to make contact with the plurality of terminals, respectively.

7. The washing machine of claim 1, wherein the conductivity data stored in the memory includes voltage data.

8. The washing machine of claim 7, wherein the controller is configured to:

detect a voltage that is applied on an electrode of the plurality of electrode sensors by applying a current through the plurality of electrode sensors, and based on the detected voltage matching the voltage data stored in the memory, determine the additive contained in the plurality of cartridges to be the corresponding type of the additive.

9. The washing machine of claim 7, further comprising a communication unit configured to:

transmit data detected from the plurality of electrode sensors to a server, and receive data related to the conductivity of the additive from the server.

10. The washing machine of claim 9, wherein the controller is configured to update the memory based on the received data that is related to the conductivity of the additive.

11. The washing machine of claim 1, further comprising an input unit configured to receive a washing course, wherein the controller is configured to:

select the additive to be input to the tub according to the received washing course, and establish fluid communication between the pump and one of the plurality of the cartridges that contains the selected additive.

12. The washing machine of claim 11, wherein the detergent supply device further comprises:

an inlet flow path that includes a plurality of flow paths that are connected to the plurality of cartridges, respectively; and a flow path switching valve configured to selectively communicate the pump with one of the plurality of flow paths of the inlet flow path.

13. The washing machine of claim 12, wherein the controller is configured to control the flow path switching valve to communicate the pump with the one of the flow paths that are connected to the one of the plurality of cartridges containing the selected additive.

14. The washing machine of claim 1, wherein the controller is configured to extract a determined additive by the pump.

15. The washing machine of claim 1, further comprising a display unit configured to display the determined type of the additive contained in each of the plurality of cartridges.

* * * * *